US010625321B2

(12) United States Patent
Serizawa et al.

(10) Patent No.: US 10,625,321 B2
(45) Date of Patent: Apr. 21, 2020

(54) COOLING APPARATUS AND COOLING METHOD FOR STEEL MATERIAL

(71) Applicant: NIPPON STEEL & SUMITOMO METAL CORPORATION, Tokyo (JP)

(72) Inventors: Yoshihiro Serizawa, Sakura (JP); Akihiro Sakamoto, Kisarazu (JP); Masahito Tasaka, Nishinomiya (JP); Naoaki Shimada, Kisarazu (JP); Ryuji Hamada, Kimitsu (JP); Hideki Matsuda, Chiba (JP); Norimasa Yamasaki, Kisarazu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 378 days.

(21) Appl. No.: 15/516,853

(22) PCT Filed: Oct. 5, 2015

(86) PCT No.: PCT/JP2015/078240
§ 371 (c)(1),
(2) Date: Apr. 4, 2017

(87) PCT Pub. No.: WO2016/056517
PCT Pub. Date: Apr. 14, 2016

(65) Prior Publication Data

US 2017/0304883 A1 Oct. 26, 2017

(30) Foreign Application Priority Data

Oct. 7, 2014 (JP) ..... 2014-206255
Oct. 7, 2014 (JP) ..... 2014-206256
(Continued)

(51) Int. Cl.
*B21D 7/16* (2006.01)

(52) U.S. Cl.
CPC ..... *B21D 7/165* (2013.01); *B21D 7/16* (2013.01)

(58) Field of Classification Search
CPC ... B21D 7/06; B21D 7/08; B21D 7/16; B21D 7/162; B21D 7/165; C21D 1/62
(Continued)

(56) References Cited

U.S. PATENT DOCUMENTS 4,596,128 A * 6/1986 Ringersma ..... B21D 7/025 72/128
5,027,634 A * 7/1991 Visser ..... B21C 29/00 148/702
(Continued)

FOREIGN PATENT DOCUMENTS

CN 101379200 A 3/2009
CN 102196869 A 9/2011
(Continued)

OTHER PUBLICATIONS

SAIDA, Translation JP-63126621-A (Year: 1988).*
(Continued)

*Primary Examiner* — Adam J Eiseman
*Assistant Examiner* — Bobby Yeonjin Kim
(74) *Attorney, Agent, or Firm* — Birch, Stewart, Kolasch & Birch, LLP

(57) ABSTRACT

According to the present invention, there is provided a cooling apparatus for a steel material in which one portion in a longitudinal direction of an elongated steel material (10) is heated while the steel material is fed in the longitudinal direction in a state where one end portion of the steel material is gripped, and the one end portion is moved in a two-dimensional or three-dimensional direction so as to form the steel material into a predetermined shape including a bent portion and thereafter to cool a heated portion including the bent portion. The cooling apparatus includes a first cooling apparatus (22) that ejects a first cooling medium to the heated portion, and a second cooling apparatus (23)
(Continued)

that is disposed on a downstream side from the first cooling apparatus when viewed along a feeding direction of the steel material, and that ejects a second cooling medium to the heated portion. A plurality of the second cooling apparatuses are disposed along the feeding direction, and flow rates of the second cooling media can be controlled independently of each other. According to the configuration, it is possible to reduce the insufficient quenching of the steel material.

20 Claims, 22 Drawing Sheets

(30) Foreign Application Priority Data

Oct. 16, 2014 (JP) ..... 2014-211900
Oct. 16, 2014 (JP) ..... 2014-211903

(58) Field of Classification Search
USPC ..... 72/342.2, 342.5, 342.6, 369; 266/114, 266/259
See application file for complete search history.

(56) References Cited

U.S. PATENT DOCUMENTS

| | | | | |
|---|---|---|---|---|
| 2007/0181234 | A1* | 8/2007 | Nallen | C21D 1/62 148/660 |
| 2008/0066517 | A1 | 3/2008 | Tomizawa et al. | |
| 2012/0175029 | A1* | 7/2012 | Tomizawa | B21D 7/16 148/714 |
| 2017/0072446 | A1 | 3/2017 | Tomizawa et al. | |

FOREIGN PATENT DOCUMENTS

| | | | | |
|---|---|---|---|---|
| CN | 102641924 | A | | 8/2012 |
| JP | 63-126621 | A | | 5/1988 |
| JP | 63126621 | A | * | 5/1988 |
| JP | 8-10856 | A | | 1/1996 |
| JP | 2006-283179 | A | | 10/2006 |
| JP | 2007-83304 | A | | 4/2007 |
| JP | 2009-526135 | A | | 7/2009 |
| JP | 2011-89151 | A | | 5/2011 |
| JP | 4825019 | B2 | | 11/2011 |
| JP | 2013-176808 | A | | 9/2013 |
| JP | 2013-230504 | A | | 11/2013 |
| WO | WO 2007/092917 | A2 | | 8/2007 |
| WO | WO 2013/132912 | A1 | | 9/2013 |

OTHER PUBLICATIONS

International Search Report for PCT/JP2015/078240 (PCT/ISA/210) dated Dec. 22, 2015.
Written Opinion of the International Searching Authority for PCT/JP2015/078240 (PCT/ISA/237) dated Dec. 22, 2015.
Chinese Office Action and Search Report dated Mar. 2, 2018 for corresponding Chinese Application No. 201580053970.0, with English translation.

* cited by examiner

COOLING APPARATUS AND COOLING METHOD FOR STEEL MATERIAL

TECHNICAL FIELD OF THE INVENTION

The present invention relates to a cooling apparatus and a cooling method for a steel material.

Priority is claimed on Japanese Patent Application No. 2014-206255, filed on Oct. 7, 2014, Japanese Patent Application No. 2014-206256, filed on Oct. 7, 2014, Japanese Patent Application No. 2014-211900, filed on Oct. 16, 2014, and Japanese Patent Application No. 2014-211903, filed on Oct. 16, 2014, the contents of which are incorporated herein by reference.

RELATED ART

In recent years, as structural steel materials used for building materials or mechanical components, those which have light weight and which have improved strength have been required. For example, as for an automotive steel material which is one of the structural steel materials, there is an increasing need to ensure safety for a vehicle body. In addition, in order to reduce the influence on the global environment, there is an increasing need to suppress $CO_2$ emission during a manufacturing process. In order to satisfy the above-described needs, the automotive steel material which is lighter in weight and has further improved strength is required.

On the other hand, a microstructure of the automotive steel material is more diversified and complicated than that in the related art. In order to use this automotive steel material, a bending technique is required which enables bending to be performed to a steel material into various and complicated shapes.

In the related art, as the above-described bending technique, a bending technique is employed in which the bending is performed in a state where the steel material is locally heated, and immediately after the heating, the steel material is rapidly cooled with water. In this manner, the steel material is formed into a predetermined shape which includes a bent portion. According to this bending technique, it is possible to bend the steel material into a complicated shape and to lighten and strengthen the steel material. Furthermore, according to the above-described bending technique, excellent productivity is achieved since the bending can be performed to the steel material through a single process.

Patent Document 1 discloses the following bending technique. While the steel material rotatably gripped by a support device is extruded from an upstream side, the bending is performed to the steel material using a heating apparatus, a cooling apparatus, and movable roller dies which are disposed on a downstream side of the support device. According to the bending technique disclosed in Patent Document 1, the following method is disclosed. The steel material is locally heated using the heating apparatus so as to form a heated portion. A bending moment is provided for the heated portion by the movable roller dies. Thereafter, a cooling medium is ejected to the heated portion from the cooling apparatus, thereby cooling the heated portion.

Patent Document 2 discloses the following method. While the heated portion is formed in the steel material using the heating apparatus, inert gas or reducing gas is sprayed to the heated portion until the cooling medium is sprayed to the heated portion from the cooling apparatus. In this manner, a surface of the heated portion is prevented from being oxidized, thereby preventing a scale from being formed on the surface of the heated portion.

Patent Document 3 discloses the following method. A pipe body of the steel material externally fitted to a guide having a curved section is extruded while being heated inside a heating and molding furnace. After the pipe body is molded along the curved section, the cooling medium is ejected to the pipe body, thereby cooling the pipe body of the steel material.

Patent Document 4 discloses the following method. The steel material is cooled using the cooling apparatus for the steel material in which a plurality of headers having a nozzle for ejecting the cooling medium to the steel material are disposed in a longitudinal direction of the steel material. The cooling apparatus for the steel material disclosed in Patent Document 4 has at least two cooling medium supply systems which are independently openable and closeable. The header and any one of the cooling medium supply systems are connected to each other. In this manner, a cooling rate can be changed depending on a position in the longitudinal direction of the steel material. The cooling apparatus for the steel material disclosed in Patent Document 4 is the cooling apparatus for cooling the steel material (straight pipe) which is not subjected to bending.

PRIOR ART DOCUMENT

Patent Document

[Patent Document 1] Japanese Unexamined Patent Application, First Publication No. 2007-83304

[Patent Document 2] Japanese Unexamined Patent Application, First Publication No. 2011-89151

[Patent Document 3] Japanese Unexamined Patent Application, First Publication No. H8-10856

[Patent Document 4] Japanese Unexamined Patent Application, First Publication No. 2006-283179

DISCLOSURE OF THE INVENTION

Problems to be Solved by the Invention

However, the present inventors performed temperature measurement of the steel material, collision pressure measurement of the cooling medium ejected to the heated portion, and numerical analysis. As a result, according to the cooling method for the steel material disclosed in Patent Document 1, cooling is insufficient during bending. Accordingly, the inventors found that an insufficient quenching may appear on a bent member manufactured by bending the steel material, that is, a fact that a steel material microstructure may become non-uniform. Specifically, the inventors found that the insufficient quenching appears on an outer side of the bent portion of the bent member.

FIG. 22 is a schematic view showing a state where a steel material 200 is cooled according to the cooling method for the steel material 200 in Patent Document 1.

As shown in FIG. 22, in a case where the steel material 200 is cooled using a cooling apparatus 210, a cooling medium ejected from the cooling apparatus 210 moves straight forward in a feeding direction (X-axis direction in FIG. 22) of the steel material 200. According to the cooling method shown in FIG. 22, the cooling medium does not collide with an outer circumferential surface 201 of a bent portion (region surrounded by a dotted line in FIG. 22) of the steel material 200. Thus, the outer circumferential surface 201 of the bent portion is insufficiently cooled, thereby causing an insufficient quenching to appear on the steel material 200. In particular, in a case where bending is performed to the steel material 200 into a complicated shape or in a case where feeding speed of the steel material 200 is fast, insufficient quenching is likely to appear on the steel material 200.

According to the cooling method for the steel material 200 in Patent Document 2, similarly to the cooling method for the steel material 200 in Patent Document 1, the insufficient quenching may also appear on the steel material 200.

According to the cooling method for the steel material 200 in Patent Document 2, the cooling medium is ejected from two locations along the feeding direction of the steel material 200. When viewed along the feeding direction of the steel material 200, an ejection position of the cooling medium located further upward is called a first position, and an ejection position of the cooling medium located further downward is called a second position.

According to the cooling method for the steel material 200 in Patent Document 2, at the first position, the cooling medium is obliquely ejected in the feeding direction of the steel material 200. At the second position, the cooling medium is ejected in a direction vertical to the feeding direction of the steel material 200. In a case where a bent shape of the steel material 200 is complicated, the cooling medium ejected from the first position collides with the steel material 200. However, the cooling medium ejected from the second position may not collide with the steel material 200 in a case where a bent shape of the steel material 200 is complicated.

Furthermore, Patent Document 2 does not disclose a specific control method of the cooling medium ejected from the second position. Therefore, the cooling medium ejected from the second position cannot pass through the cooling medium ejected from the first position flowing along the steel material 200. Consequently, it is considered that the cooling medium ejected from the second position does not reach the steel material 200.

For the above-described reason, according to the cooling method for the steel material 200 in Patent Document 2, similarly to the cooling method for the steel material 200 in Patent Document 1, the cooling medium does not collide with the outer circumferential surface of the bent portion, and the outer circumferential surface of a bent portion is insufficiently cooled. Consequently, the insufficient quenching may also appear on the steel material 200.

According to the cooling method for the steel material 200 in Patent Document 3, the cooling medium is ejected from a pair of hollow annular bodies internally having a nozzle to the steel material 200 inserted into the hollow annular bodies. A pair of the hollow annular bodies are disposed back and forth in accordance with a bent shape of the steel material 200. Therefore, in a case where the bending is performed to the steel material 200 in a direction different from a direction in which a pair of the hollow annular bodies are disposed, there is a possibility that the steel material 200 may come into contact with the hollow annular bodies during the bending. Since the cooling medium does not collide with the outer circumferential surface of the bent portion, the outer side of the bent portion is insufficiently cooled. Therefore, there is a possibility that the insufficient quenching may appear on the steel material 200.

The cooling method for the steel material 200 in Patent Document 4 is the cooling method for cooling the steel material (straight pipe) 200 which is not subjected to bending. Accordingly, in a case where the cooling method is used in cooling the steel material 200 which is subjected to bending, the cooling medium does not collide with the outer circumferential surface of the bent portion. Consequently, there is a possibility that the insufficient quenching may appear.

The present invention is made in view of the above-described circumstances, and an object thereof is to provide a cooling apparatus and a cooling method for a steel material, which can reduce an insufficient quenching of the steel material.

Means for Solving the Problem

In order to solve the above-described problem and to achieve the object, the present invention adopts the following configurations.

(1) According to an aspect of the present invention, there is provided a cooling apparatus for a steel material in which one portion in a longitudinal direction of an elongated steel material is heated while the steel material is fed in the longitudinal direction in a state where one end portion of the steel material is gripped, and the one end portion is moved in a two-dimensional or three-dimensional direction so as to form the steel material into a predetermined shape including a bent portion and thereafter to cool a heated portion including the bent portion. The cooling apparatus includes a first cooling apparatus that ejects a first cooling medium to the heated portion, and a second cooling apparatus that is disposed on a downstream side than the first cooling apparatus when viewed along a feeding direction of the steel material, and that ejects a second cooling medium to the heated portion. A plurality of the second cooling apparatuses are disposed along the feeding direction, and flow rates of the second cooling media can be controlled independently of each other.

(2) In the cooling apparatus for a steel material described in (1) above, a configuration may be adopted which further includes a moving mechanism that maintains each arrangement interval to be constant between the respective second cooling apparatuses adjacent to each other, and that causes an arrangement of the respective second cooling apparatuses to follow the predetermined shape.

(3) In the cooling apparatus for a steel material described in (2) above, a configuration may be adopted in which the moving mechanism is a passive moving mechanism that has a contact portion which causes the arrangement of the respective second cooling apparatuses to follow the predetermined shape of the steel material by coming into contact with an outer shape of the steel material, and a connecting portion which connects the respective second cooling apparatuses adjacent to each other.

(4) In the cooling apparatus for a steel material described in (2) above, a configuration may be adopted in which the moving mechanism is a passive moving mechanism that has a contact portion which causes the arrangement of the respective second cooling apparatuses to follow the predetermined shape of the steel material by contacting with an outer shape of the steel material, and a guide portion which regulates a moving direction of the respective second cooling apparatuses.

(5) In the cooling apparatus for a steel material described in (2) above, a configuration may be adopted in which the moving mechanism is an active moving mechanism that has a drive unit which moves the respective second cooling apparatuses in accordance with the predetermined shape which is scheduled to apply to the steel material.

(6) In the cooling apparatus for a steel material described in any one aspect of (1) to (5) above, a configuration may be adopted in which the second cooling apparatus includes a plurality of cooling mechanisms that are disposed along a circumferential direction of the steel material, and that respectively eject the second cooling medium in a manner flow rates of the second cooling media are controllable independently of each other.

(7) In the cooling apparatus for the steel material described in (6) above, a configuration may be adopted in which the respective cooling mechanisms are disposed so that the second cooling media ejected from the respective cooling mechanisms do not cross each other until the second cooling media reach the steel material ejected from the respective cooling mechanisms.

(8) In the cooling apparatus for a steel material described in any one aspect of (1) to (7) above, a configuration may be adopted in which the second cooling apparatus located on a downstream side has a relatively larger inner diameter dimension of a space into which the steel material is inserted than the second cooling apparatus located on an upstream side when viewed along the feeding direction.

(9) In the cooling apparatus for a steel material described in any one aspect of (1) to (8) above, a configuration may be adopted which further includes a first draining mechanism that drains the first cooling medium flowing downward, at an upstream position than a collision position where the second cooling medium ejected from any one located at a most upstream side in the respective second cooling apparatuses collides with the steel material.

(10) In the cooling apparatus for a steel material described in any one aspect of (1) to (9) above, a configuration may be adopted which further includes a plurality of second draining mechanisms that drain the second cooling medium flowing downward, at a downstream position than a collision position where the second cooling medium ejected from any one of the respective second cooling apparatuses collides with the steel material.

(11) In the cooling apparatus for a steel material described in any one aspect of (1) to (10) above, a configuration may be adopted in which at least one of the respective second cooling apparatuses has a pulsation applying mechanism that applies a pulsation to the second cooling medium.

(12) In the cooling apparatus for a steel material described in any one aspect of (1) to (11) above, a configuration may be adopted in which at least a momentum of the second cooling medium ejected at a most upstream position in the second cooling media is greater than a momentum of the first cooling medium ejected at a position adjacent to the most upstream position.

(13) In the cooling apparatus for a steel material described in any one aspect of (1) to (12) above, a configuration may be adopted in which the first cooling medium is a columnar jet, and in which the second cooling medium is any one of a flat jet, a full cone jet, and an oval jet.

(14) According to an aspect of the present invention, there is provided a cooling method for a steel material in which one portion in a longitudinal direction of an elongated steel material is heated while the steel material is fed in the longitudinal direction in a state where one end portion of the steel material is gripped, and the one end portion is moved in a two-dimensional or three-dimensional direction so as to form the steel material into a predetermined shape including a bent portion and thereafter to cool a heated portion including the bent portion. The cooling method includes a first cooling process of ejecting a first cooling medium to the heated portion, and a second cooling process of ejecting a second cooling medium to the heated portion, on a downstream side than an ejection position of the first cooling apparatus when viewed along a feeding direction of the steel material. During the second cooling process, the second cooling media are ejected to a plurality of locations along the feeding direction of the steel material while flow rates of the second cooling media are controlled independently of each other.

(15) In the cooling method for a steel material described in (14) above, a configuration may be adopted in which the second cooling process includes a moving process of maintaining each ejection interval to be constant in the feeding direction during ejecting the second cooling media to a plurality of locations along the feeding direction, and of causing an arrangement of respective collision positions where the second cooling medium collides with the steel material to follow the predetermined shape of the steel material.

(16) In the cooling method for a steel material described in (15) above, a configuration may be adopted so that the moving process is a passive moving process in which the predetermined shape of the steel material which is obtained by contacting an outer shape of the steel material is reflected on each arrangement of a plurality of second cooling apparatuses which ejects the second cooling medium and which is disposed along the feeding direction, and the respective second cooling apparatuses are connected to each other so as to maintain each of the ejection interval to be constant in the feeding direction of the second cooling medium.

(17) In the cooling method for a steel material described in (15) above, a configuration may be adopted so that the moving process is a passive moving process in which the predetermined shape of the steel material which is obtained by contacting with an outer shape of the steel material is reflected on each arrangement of a plurality of second cooling apparatuses which ejects the second cooling medium and which is disposed along the feeding direction, and a moving direction of the respective second cooling apparatuses is regulated by a guide.

(18) In the cooling method for a steel material described in (15) above, a configuration may be adopted so that the moving process is an active moving process in which an ejection position of the second cooling medium is actively moved in accordance with the predetermined shape which is scheduled to apply to the steel material.

(19) In the cooling method for a steel material described in any one aspect of (14) to (18) above, a configuration may be adopted so that during the second cooling process, the second cooling media are ejected from a plurality of positions along a circumferential direction of the steel material in a manner flow rates of the second cooling media are controllable independently of each other in the second cooling process.

(20) In the cooling method for a steel material described in (19) above, a configuration may be adopted so that ejection positions of the second cooling media are disposed so that the second cooling media adjacent to each other in the circumferential direction do not cross each other until the second cooling media collide with the steel material.

(21) In the cooling method for a steel material described in any one aspect of (14) to (20) above, a configuration may be adopted which further includes a plurality of first draining processes of draining the first cooling medium flowing downward, at an upstream position from a collision position where the second cooling medium located at a most upstream side in the respective second cooling media collides with the steel material.

(22) In the cooling method for the steel material described in any one aspect of (14) to (21) above, a configuration may be adopted which further includes a second draining process of draining the second cooling medium flowing downward, at a downstream position than a collision position where the second cooling medium collides with the steel material in each of the plurality of locations.

(23) In the cooling method for the steel material described in any one aspect of (14) to (22) above, a configuration may be adopted which further includes a pulsation applying process of applying at least one of the second cooling media.

(24) In the cooling method for the steel material described in any one aspect of (14) to (23) above, a configuration may be adopted so that at least a momentum of the second cooling medium ejected at a most upstream position in the second cooling media is greater than a momentum of the first cooling medium ejected at a position adjacent to the most upstream position.

Effects of the Invention

According to the above-described aspects, it is possible to provide a cooling apparatus and a cooling method for a steel material, which can reduce an insufficient quenching when bending the steel material.

EMBODIMENTS OF THE INVENTION

Hereinafter, a cooling apparatus for a steel material and a cooling method for a steel material according to embodiments will be described with reference to the drawings.

First Embodiment, Cooling Apparatus for Steel Material

First, a bending device including a cooling apparatus for a steel material 10 according to a first embodiment will be described with reference to FIG. 1.

Figure 1:
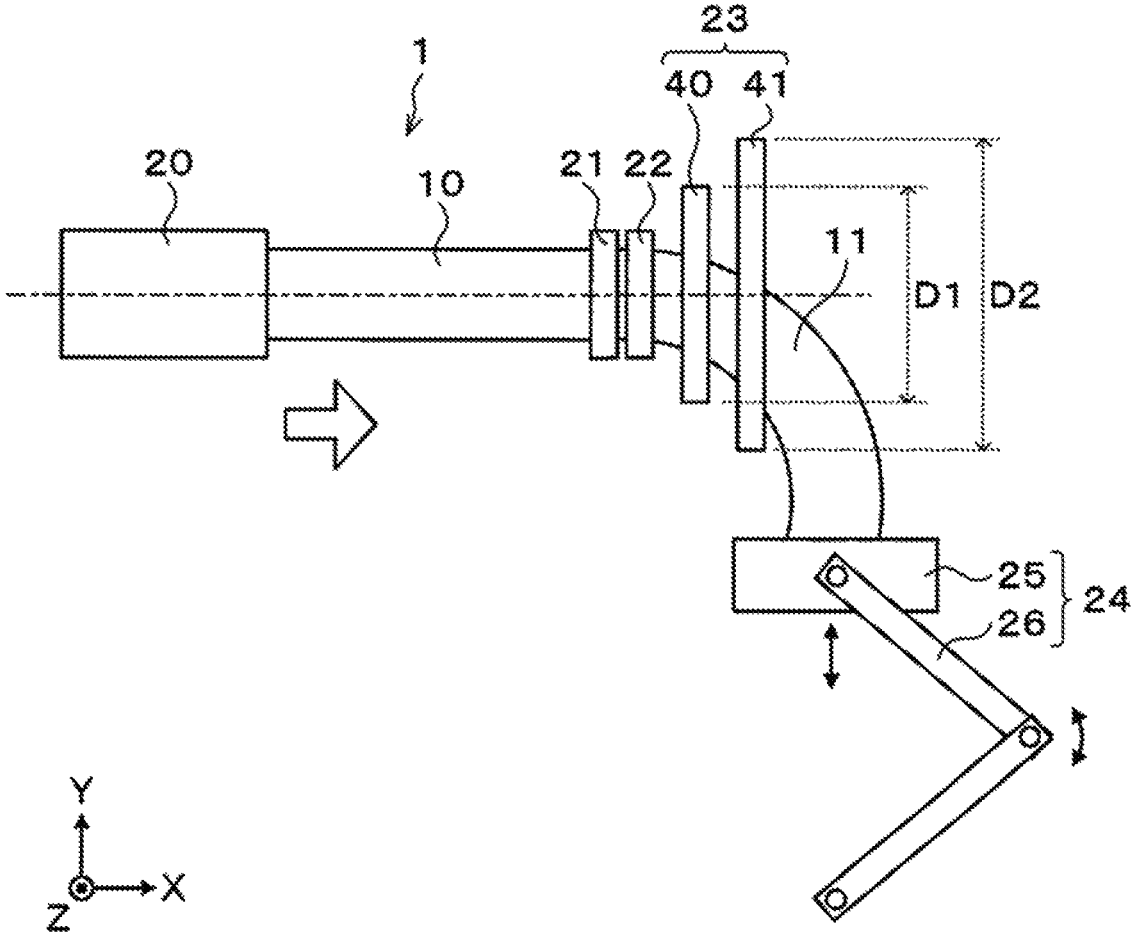
FIG. 1 is a schematic view showing a configuration of a bending device including a cooling apparatus according to a first embodiment.

FIG. 1 is a schematic view showing a configuration of a bending device 1 including the cooling apparatus for the steel material 10 according to the first embodiment.

The bending device 1 performs bending of steel material 10 while intermittently or continuously feeding the elongated steel material 10. In a case where the bending device 1 is viewed along a feeding direction of the steel material 10, the bending device 1 includes a feeding apparatus 20, a heating apparatus 21, a first cooling apparatus 22, a second cooling apparatus 23, and a bending apparatus 24, sequentially from an upstream side.

In the present embodiment, a direction in which the steel material 10 is fed in a longitudinal direction (pipe axis direction) (X-axis direction in FIG. 1) is referred to as the feeding direction. Unless otherwise particularly described, an upstream side means an upstream side (side in a negative X-axis direction in FIG. 1) in the feeding direction of the steel material 10. A downstream side means a downstream side (side in a positive X-axis direction in FIG. 1) in the feeding direction of the steel material 10.

A configuration of the bending device 1 is not limited to the above-described configuration. In addition, in the present embodiment, a case will be described where the steel material 10 is a flat steel pipe (flat pipe). However, for example, the present invention is also applicable to a case where the steel material 10 is a steel pipe such as a round pipe and a rectangular pipe, or a case where the steel material 10 has no pipe shape.

(Feeding Apparatus)

The feeding apparatus 20 intermittently or continuously feeds the steel material 10, whose one end portion (front end portion) is gripped by the bending apparatus 24, in the longitudinal direction (pipe axis direction). The feeding apparatus 20 can adopt a known configuration, and is not particularly limited to a specific configuration. As shown in FIG. 1, the feeding apparatus 20 may grip the other end portion (rear end portion) of the steel material 10.

(Heating Apparatus)

The heating apparatus 21 heats a portion in the longitudinal direction of the steel material 10 using a high frequency induction heating coil which is annularly disposed around the steel material 10, for example.

(Bending Apparatus)

The bending apparatus 24 grips the front end portion of the steel material 10, and moves the front end portion of the steel material 10 in a two-dimensional direction or three-dimensional direction, thereby forming a bend (bent portion) 11 in the steel material 10. The bending apparatus 24 has a clamp 25 for gripping the front end portion of the steel material 10, and a drive arm 26 for moving the clamp 25.

(Cooling Apparatus)

The cooling apparatus for the steel material 10 according to the present embodiment includes a first cooling apparatus (primary cooling apparatus) 22 and a second cooling apparatus (secondary cooling apparatus) 23.

The first cooling apparatus 22 ejects a first cooling medium 35 to a portion in the longitudinal direction of the steel material 10 heated by the heating apparatus 21 (hereinafter, referred to as a heated portion). The heated portion includes the bent portion 11.

When viewed along the feeding direction of the steel material 10, the second cooling apparatus 23 is disposed on the downstream side from the first cooling apparatus 22, and ejects a second cooling medium 55 to the heated portion. The second cooling apparatus 23 includes a plurality of cooling mechanisms that are disposed along the feeding direction of the steel material 10, and that can control a flow rate of the second cooling medium 55 independently of each other. The second cooling apparatus 23 shown in FIG. 1 includes a first cooling mechanism 40 and a second cooling mechanism 41.

As the first cooling medium 35 and the second cooling medium 55, it is preferable to use cooling water.

Each detailed configuration of the first cooling apparatus 22 and the second cooling apparatus 23 will be described later.

In the bending device 1, in a state where the front end portion is gripped by the clamp 25, the feeding apparatus 20 feeds the steel material 10. The fed steel material 10 is heated to a predetermined temperature by the heating apparatus 21. Furthermore, the clamp 25 is moved in the two-dimensional direction or the three-dimensional direction by the drive arm 26, thereby providing the heated portion of the steel material 10 with a bending moment. In this manner, the steel material 10 is formed into a predetermined shape including the bent portion 11. After the bending moment is applied to the heated portion of the steel material 10, the steel material 10 is cooled by the first cooling medium 35 ejected from the first cooling apparatus 22. Furthermore, the steel material 10 is cooled by the second cooling medium 55 ejected from the second cooling apparatus 23.

In the present embodiment, cooling the steel material 10 using the first cooling medium 35 is referred to as primary cooling, and cooling the steel material 10 using the second cooling medium 55 is referred to as secondary cooling.

Figure 2:
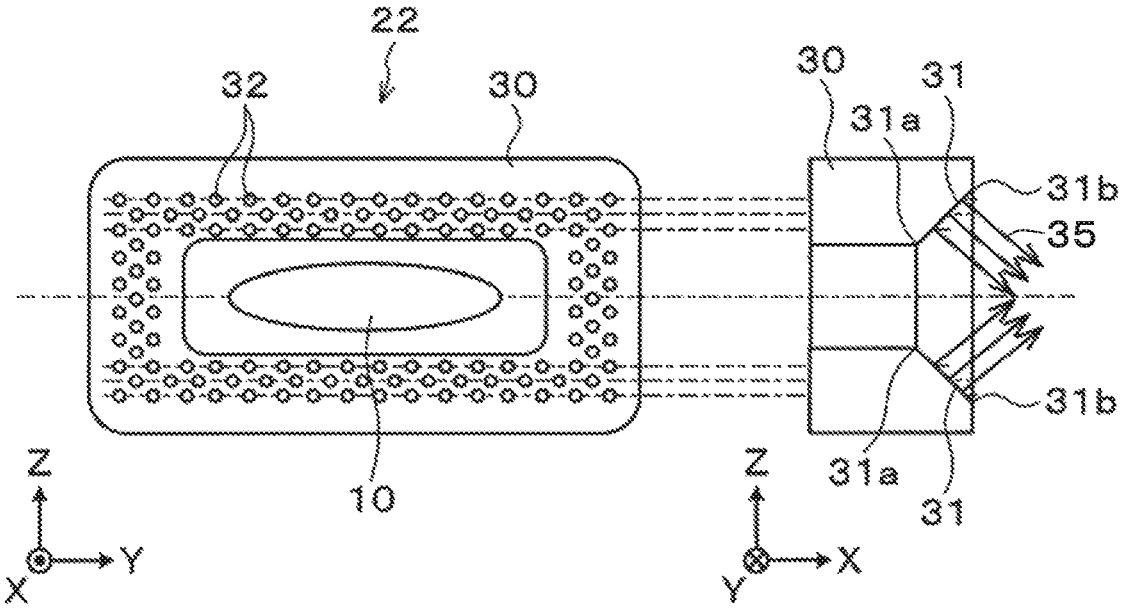
FIG. 2 is a schematic view showing a configuration of a first cooling apparatus according to the first embodiment.
Figure 3:
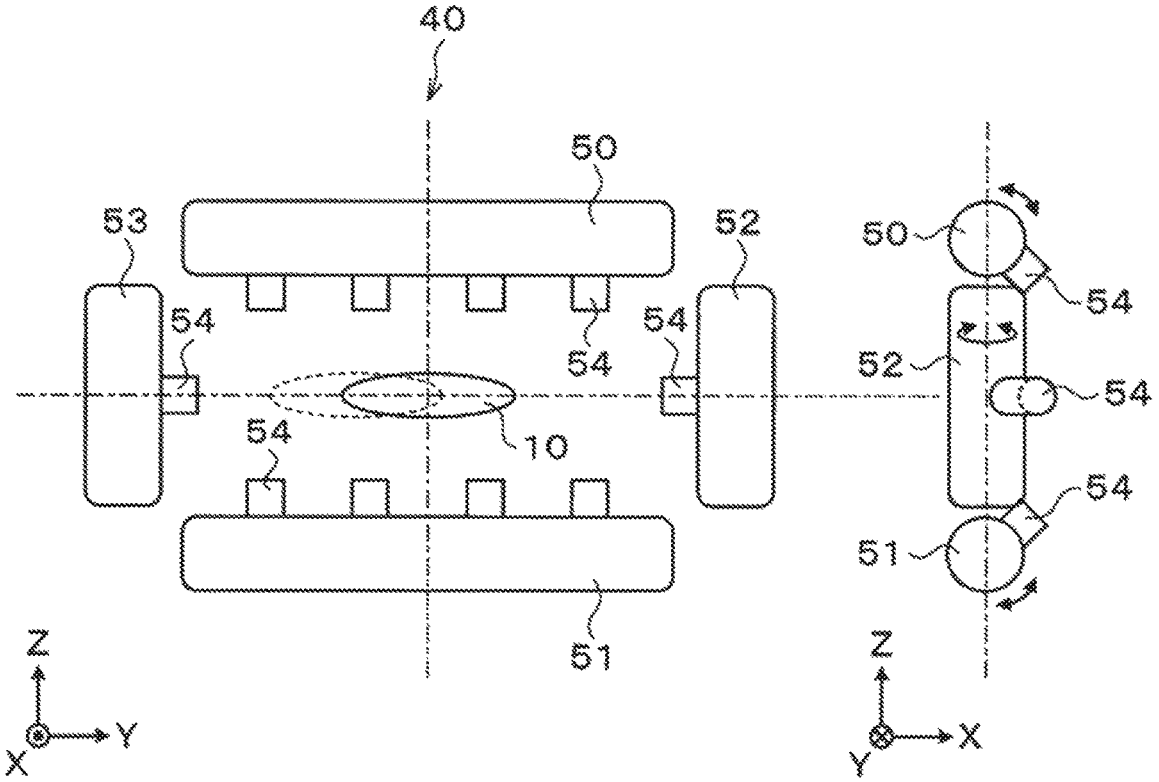
FIG. 3 is a schematic view showing a configuration of a first cooling mechanism according to the first embodiment.
Figure 4:
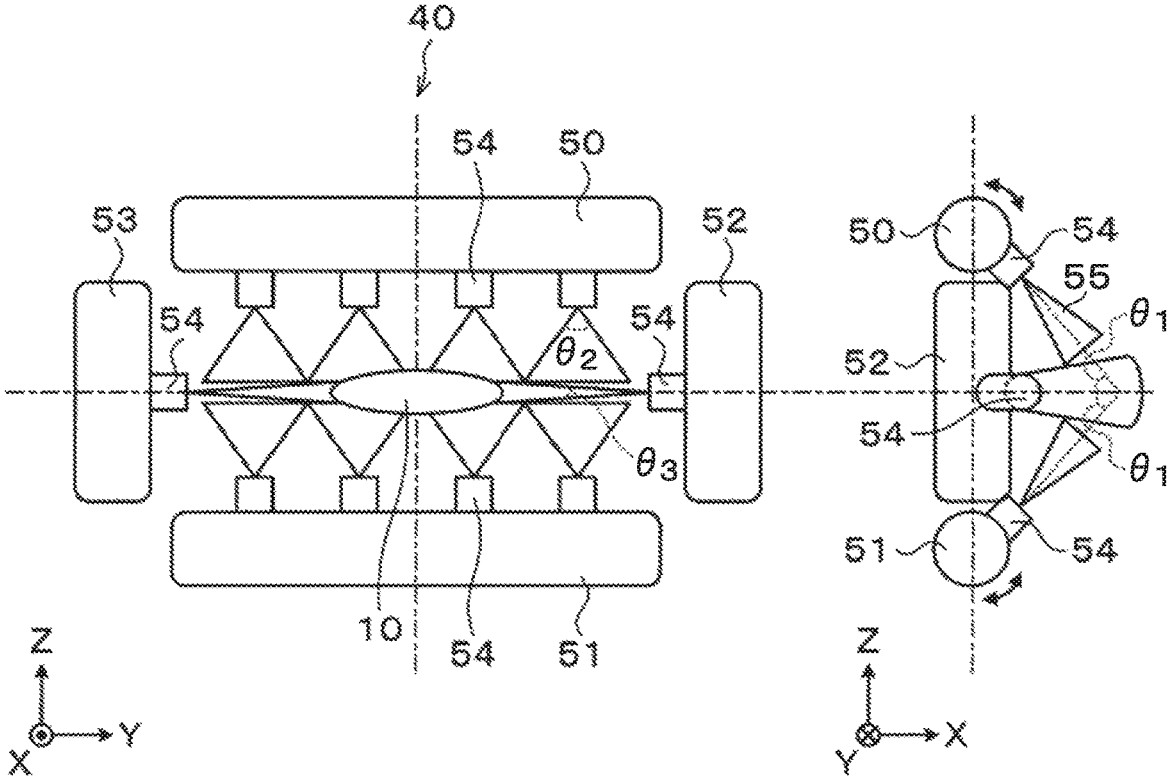
FIG. 4 is a schematic view showing a state where the first cooling mechanism according to the first embodiment ejects a second cooling medium.
Figure 5:
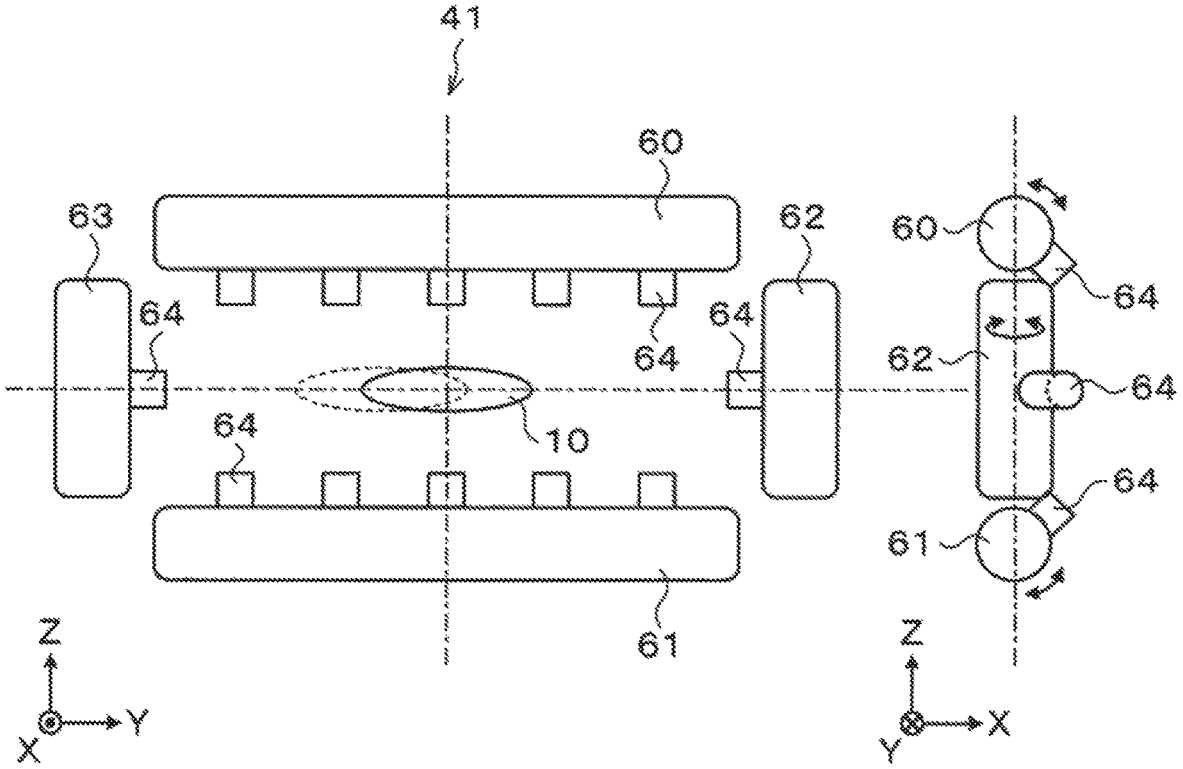
FIG. 5 is a schematic view showing a configuration of a second cooling mechanism according to the first embodiment.

Next, the first cooling apparatus 22 and the second cooling apparatus 23 according to the present embodiment will be described. FIG. 2 is a schematic view showing a configuration of the first cooling apparatus 22 according to the present embodiment. FIG. 3 is a schematic view showing a configuration of the first cooling mechanism 40 according to the present embodiment. FIG. 4 is a schematic view showing a state where the first cooling mechanism 40 according to the present embodiment ejects the second cooling medium 55. FIG. 5 is a schematic view showing a configuration of the second cooling mechanism 41 according to the present embodiment.

(First Cooling Apparatus)

As shown in FIG. 2, the first cooling apparatus 22 has a header 30 that is annularly disposed around the steel material 10, and that supplies the first cooling medium 35. A plurality of ejection ports 32 for ejecting the first cooling medium 35 of a columnar jet are formed on a side surface 31 on the downstream side of the header 30. In addition, in a case where the side surface 31 of the first cooling apparatus 22 is viewed along the feeding direction of the steel material 10, an inner end portion 31*a* is inclined so as to be located on the upstream side with respect to an outer end portion 31*b*. Therefore, the first cooling medium 35 ejected from the plurality of ejection ports 32 is ejected toward the downstream side.

According to ejecting the first cooling medium 35 from the first cooling apparatus 22 having the above-described configuration, it is possible to prevent the first cooling medium 35 from flowing toward the upstream side. Therefore, without hindering the steel material 10 from being heated by the heating apparatus 21, the first cooling apparatus 22 can perform the primary cooling on the steel material 10.

(Second Cooling Apparatus)

As shown in FIG. 1, in the second cooling apparatus 23, the first cooling mechanism 40 and the second cooling mechanism 41 are disposed parallel sequentially from the upstream side. The first cooling mechanism 40 and the second cooling mechanism 41 can eject the second cooling medium 55 independently of each other, and can control a flow velocity or a flow rate of the second cooling medium 55 independently of each other. The number of cooling mechanisms can be optionally set without being limited to an example according to the present embodiment.

(First Cooling Mechanism)

As shown in FIG. 3, the first cooling mechanism 40 which constitutes the second cooling apparatus 23 may include a plurality of headers 50 to 53 that are disposed along the circumferential direction of the steel material 10, and that supply the second cooling medium 55. In a case where the first cooling mechanism 40 has the headers 50 to 53, the upper header 50 is disposed vertically above the steel material 10, the lower header 51 is disposed vertically below the steel material 10, and the lateral headers 52 and 53 are respectively disposed laterally in a horizontal direction of the steel material 10. The respective headers 50 to 53 eject the second cooling medium 55 independently of each other, and can control a flow velocity or a flow rate of the second cooling medium 55 independently of each other.

Since the first cooling mechanism 40 includes the headers 50 to 53, it is possible to reliably cool the entire steel material 10 in the circumferential direction. Therefore, even in a case where the steel material 10 is formed in a complicated shape, it is possible to reduce an insufficient quenching appearing on the steel material 10.

The number of the headers 50 to 53 can be optionally set without being limited to the present embodiment.

The respective headers 50 to 53 have a spray nozzle 54. For example, as the spray nozzle 54, a flat nozzle, a full cone nozzle, or an oval nozzle is used. In a case where the above-described nozzles are used as the spray nozzle 54, the second cooling media 55 are respectively a flat jet, a full cone jet, and an oval jet.

The number of the spray nozzles 54 respectively disposed in the headers 50 to 53 is not limited to the number shown in FIG. 3, and can be optionally set.

As shown in FIG. 4, a direction of the spray nozzle 54 of the respective headers 50 to 53 may be set so that the second cooling medium 55 flows toward the downstream side.

The spray nozzle 54 of the respective headers 50 to 53 may be configured so that an ejection direction of the second cooling medium 55 can be adjusted. In this manner, the second cooling medium 55 can be ejected in accordance with a shape of the steel material 10. Even in a case where the steel material 10 is formed in a complicated shape, the second cooling medium 55 can be ejected to a circumferential surface of outer side of the bent portion 11 of the steel material 10. Therefore, even in the case where the steel material 10 is formed in the complicated shape, it is possible to reduce the insufficient quenching in a case where bending is performed to the steel material 10.

In particular, it is preferable to dispose the spray nozzle 54 of the upper header 50 and the lower header 51 in a direction in which a collision angle $\theta_1$ between the second cooling medium 55 ejected from the spray nozzle 54 and the steel material 10 is 45 degrees or smaller. If the collision angle $\theta_1$ between the second cooling medium 55 and the steel material 10 is 45 degrees or smaller, it is possible to prevent the second cooling medium 55, which collides with the steel material 10 from flowing toward the upstream side. A preferable lower limit value of the collision angle θ1 between the second cooling medium 55 and the steel material 10 is 20 degrees, for example.

It is preferable to dispose the respective spray nozzles 54 of the header 50 to 53 so that the second cooling media 55 ejected from the respective spray nozzles 54 do not cross each other until the second cooling media 55 ejected from the respective spray nozzles 54 reach the steel material 10. Since the respective spray nozzles 54 are disposed in this way, the second cooling media 55 ejected from the respective spray nozzles 54 do not interfere with each other. Accordingly, the second cooling medium 55 can be ejected to the steel material 10 using a desired collision position and a desired collision angle.

It is preferable that an ejection angle $\theta_2$ of the second cooling medium 55 ejected from the spray nozzle 54 of the upper header 50 and the lower header 51, and an ejection angle $\theta_3$ of the second cooling medium 55 ejected from the spray nozzle 54 of the lateral headers 52 and 53 are set to 10 to 70 degrees. However, in order to ensure cooling capability of the upper header 50 and the lower header 51 and to prevent an excessive increase in the number of nozzles, it is preferable that the ejection angle $\theta_2$ and the ejection angle $\theta_3$ are as wide as possible. If the ejection angle becomes larger, there is a possibility that the steel material 10 may be less likely to be uniformly cooled. Accordingly, it is preferable that the ejection angle $\theta_2$ and the ejection angle $\theta_3$ are approximately 50 degrees. However, in a case where a cooling surface of the steel material 10 is narrow, the ejection angle $\theta_2$ and the ejection angle $\theta_3$ may be approximately 10 degrees.

(Second Cooling Mechanism)

As shown in FIG. 5, the second cooling mechanism 41 which constitutes the second cooling apparatus 23 together with the first cooling mechanism 40 has the same configuration as that of the first cooling mechanism 40. That is, the second cooling mechanism 41 includes headers 60 to 63 having the same configuration as that of the headers 50 to 53. In addition, the respective headers 60 to 63 include a spray nozzle 64 having the same configuration as that of the spray nozzle 54.

As shown in FIG. 1, in a case where each width (inner diameter dimension of a space into which the steel material 10 is inserted) in a direction orthogonal to the feeding direction (Y-axis direction in FIG. 1) is compared between the first cooling mechanism 40 and the second cooling mechanism 41, a configuration may be adopted so that a width D2 of the second cooling mechanism 41 located on the downstream side is larger than a width D1 of the first cooling mechanism 40 located on the relatively upstream side. Since a bend width on the downstream side is large in the steel material 10, the width D2 of the second cooling mechanism 41 is set to be larger than the width D1 of the first cooling mechanism 40 so that the steel material 10 subjected to bending does not come into contact with the second cooling mechanism 41. The width D1 of the first cooling mechanism 40 may be the same as the width D2 of the second cooling mechanism 41.

First Embodiment, Cooling Method for Steel Material

Next, a cooling method for the steel material 10 using the first cooling apparatus 22 and the second cooling apparatus 23 according to the present embodiment will be described with reference to FIG. 6.

Figure 6:
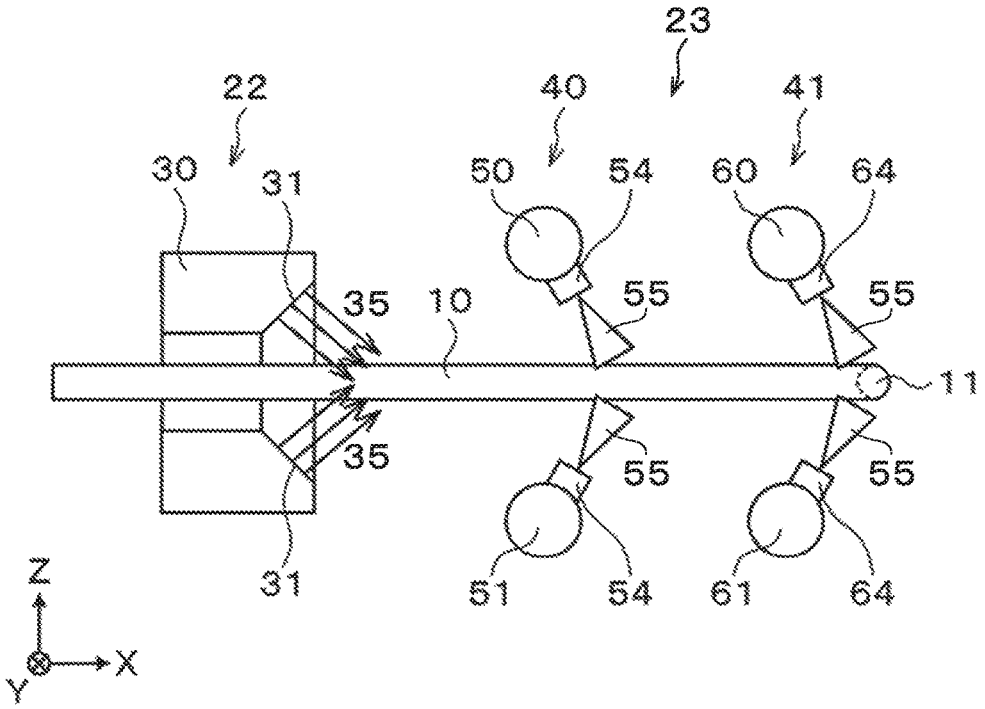
FIG. 6 is a schematic view showing a state where a steel material is cooled using the first cooling apparatus and a second cooling apparatus according to the first embodiment.

FIG. 6 is a schematic view showing a state where the steel material 10 is cooled using the first cooling apparatus 22 and the second cooling apparatus 23 according to the first embodiment.

As shown in FIG. 6, the cooling method for the steel material 10 according to the present embodiment has a process of ejecting the first cooling medium 35 to the heated portion, and a process of ejecting the second cooling medium 55 to the heated portion from the downstream side compared to the ejection position of the first cooling medium 35 when viewed along the feeding direction. In the present embodiment, the process of ejecting the first cooling medium 35 to the heated portion is referred to as a first cooling process, and the process of ejecting the second cooling medium 55 to the heated portion is referred to as a second cooling process.

In the cooling method for the steel material 10 according to the present embodiment, during the second cooling process, the second cooling media 55 are ejected to a plurality of locations along the feeding direction of the steel material 10 while controlling the flow rates of the second cooling media 55 independently of each other.

As shown in FIG. 6, the steel material 10 for which a bending moment is applied after being heated to a predetermined temperature (for example, 1000° C.) by the heating apparatus 21 is first cooled by the first cooling medium 35 ejected from the first cooling apparatus 22. Through the cooling using the first cooling medium 35, a surface of the steel material 10 is cooled to below the $Ar_3$ transformation start temperature (for example, 200° C. to 800° C.).

After the cooling using the first cooling medium 35, the steel material 10 is cooled by the second cooling medium 55 ejected from the first cooling mechanism 40 and the second cooling mechanism 41. The steel material 10 is cooled to below the martensitic transformation finish temperature Mf, or to approximately room temperature (for example, room temperature to 300° C.) by the second cooling medium 55. Since the steel material 10 is already cooled through the primary cooling, the steel material 10 is stably and efficiently cooled in a nuclear boiling region during the secondary cooling.

As shown in FIG. 6, in the cooling method for the steel material 10 according to the present embodiment, the second cooling medium 55 is ejected to the steel material 10 from the first cooling mechanism 40 and the second cooling mechanism 41. In addition, the first cooling mechanism 40 and the second cooling mechanism 41 can control flow rate distribution of the second cooling medium 55 in accordance with a curvature of the bent portion 11 in the heated portion. In this manner, in the cooling method for the steel material 10 according to the present embodiment, it is possible to reliably cool even the outer side of the bent portion 11 of the steel material 10, which is less likely to be cooled in the related art.

For the above-described reason, according to the cooling method for the steel material 10 in the present embodiment, it is possible to reduce the insufficient quenching when bending the steel material 10, which is a problem in the related art. Therefore, proper bending can be performed to the steel material 10.

In a case where a momentum of the first cooling medium 35 and a momentum of the second cooling medium 55 are compared with each other, it is preferable that the momentum of the second cooling medium 55 at least ejected from the first cooling mechanism 40 located at the most upstream position in the second cooling apparatus 23 is greater than the momentum of the first cooling medium 35 ejected from the first cooling apparatus 22 located at a position adjacent to the first cooling mechanism 40.

The momentum of the second cooling medium 55 ejected from the first cooling mechanism 40 is greater than the momentum of the first cooling medium 35 ejected from the first cooling apparatus 22. Accordingly, when the second cooling medium 55 ejected from the first cooling mechanism 40 collides with the steel material 10, even in a case where the first cooling medium 35 is present between the second cooling medium 55 and the steel material 10, the second cooling medium 55 ejected from the first cooling mechanism 40 can pass through the first cooling medium 35.

In this manner, the second cooling medium 55 ejected from the first cooling mechanism 40 reliably reaches the steel material 10, and cools the steel material 10 effectively, since the first cooling medium 35 whose temperature rises due to cooling the steel material 10 does not flow to the downstream side from the first cooling mechanism 40.

It is preferable that the momentum of the second cooling medium 55 is 1.5 times to 5 times the momentum of the first cooling medium 35.

During the second cooling process, the second cooling media 55 may be ejected from a plurality of positions along the circumferential direction of the steel material 10 while controlling the flow rates of the second cooling media 55 independently of each other. According to ejecting the second cooling media 55 from the plurality of positions along the circumferential direction of the steel material 10 while controlling the flow rates of the second cooling media 55 independently of each other, it is possible to reliably cool the entire steel material 10 in the circumferential direction. Therefore, even in a case where the steel material 10 is formed in a complicated shape, it is possible to reduce the insufficient quenching appearing on the steel material 10.

Second Embodiment, Cooling Apparatus for Steel Material

Next, the cooling apparatus for the steel material 10 according to a second embodiment will be described.

Figure 7:
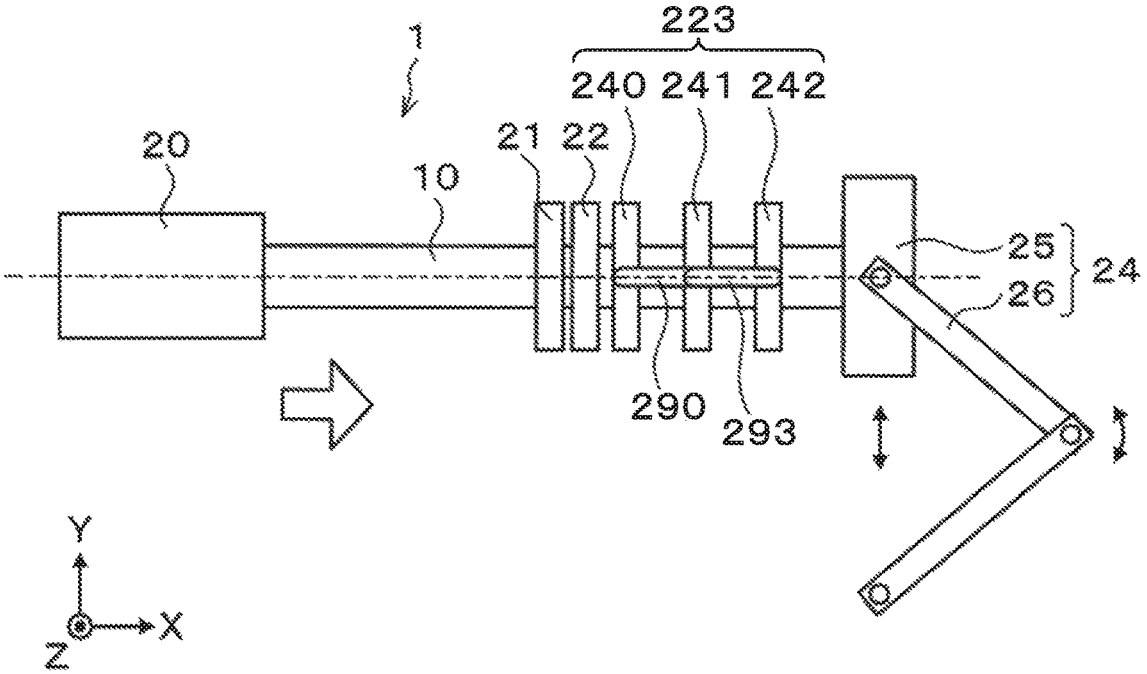
FIG. 7 is a schematic view showing a brief configuration of a bending device including a cooling apparatus according to a second embodiment.
Figure 8:
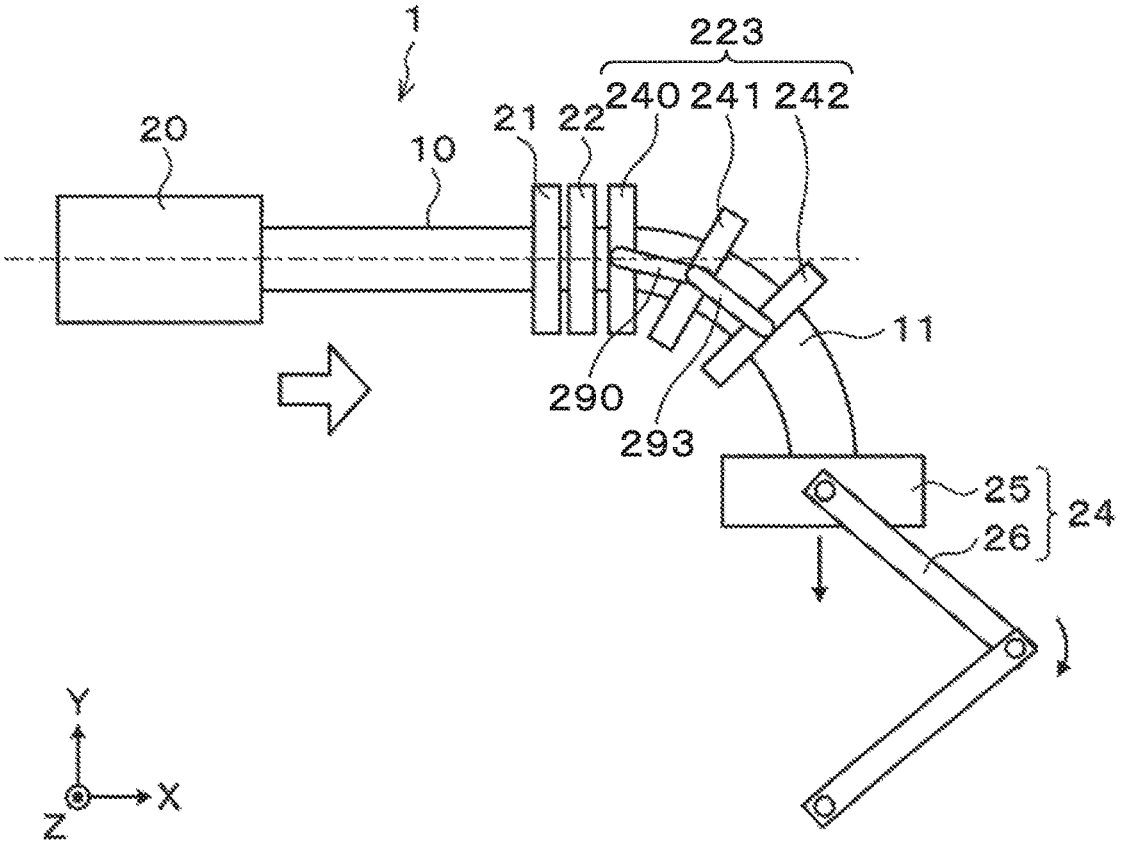
FIG. 8 is a schematic view showing a state where bending is performed to a steel material using the bending device including the cooling apparatus according to the second embodiment.

FIG. 7 is a schematic view showing a configuration of the bending device 1 for the steel material 10, which includes the cooling apparatus for the steel material 10 according to the second embodiment. FIG. 8 is a schematic view showing a state where bending is performed to the steel material 10 using the bending device 1 of the steel material 10, which includes the cooling apparatus for the steel material 10 according to the second embodiment.

With regard to elements having the same configuration as that of the bending device 1 for the steel material 10 according to the first embodiment, a detailed description will be omitted.

Similarly to the first embodiment, the cooling apparatus for the steel material 10 according to the present embodiment includes the first cooling apparatus 22, but includes a second cooling apparatus 223 unlike the first embodiment.

As shown in FIG. 7, the second cooling apparatus 223 according to the present embodiment includes a first cooling mechanism 240, a second cooling mechanism 241, and a third cooling mechanism 242. Furthermore, the second cooling apparatus 223 includes a connecting member 290 which connects the center of the first cooling mechanism 240 and the center of the second cooling mechanism 241 to each other, and a connecting member 293 which connects the center of the second cooling mechanism 241 and the center of the third cooling mechanism 242 to each other.

The second cooling apparatus 223 has the connecting members 290 and 293. Accordingly, even if bending is performed to the steel material 10 as shown in FIG. 8, a distance between the centers of the first cooling mechanism 240 and the second cooling mechanism 241, and a constant distance between the centers of the second cooling mechanism 241 and the third cooling mechanism 242 can be maintained.

Next, a detailed configuration of the second cooling apparatus 223 according to the present embodiment will be described.

Figure 9:
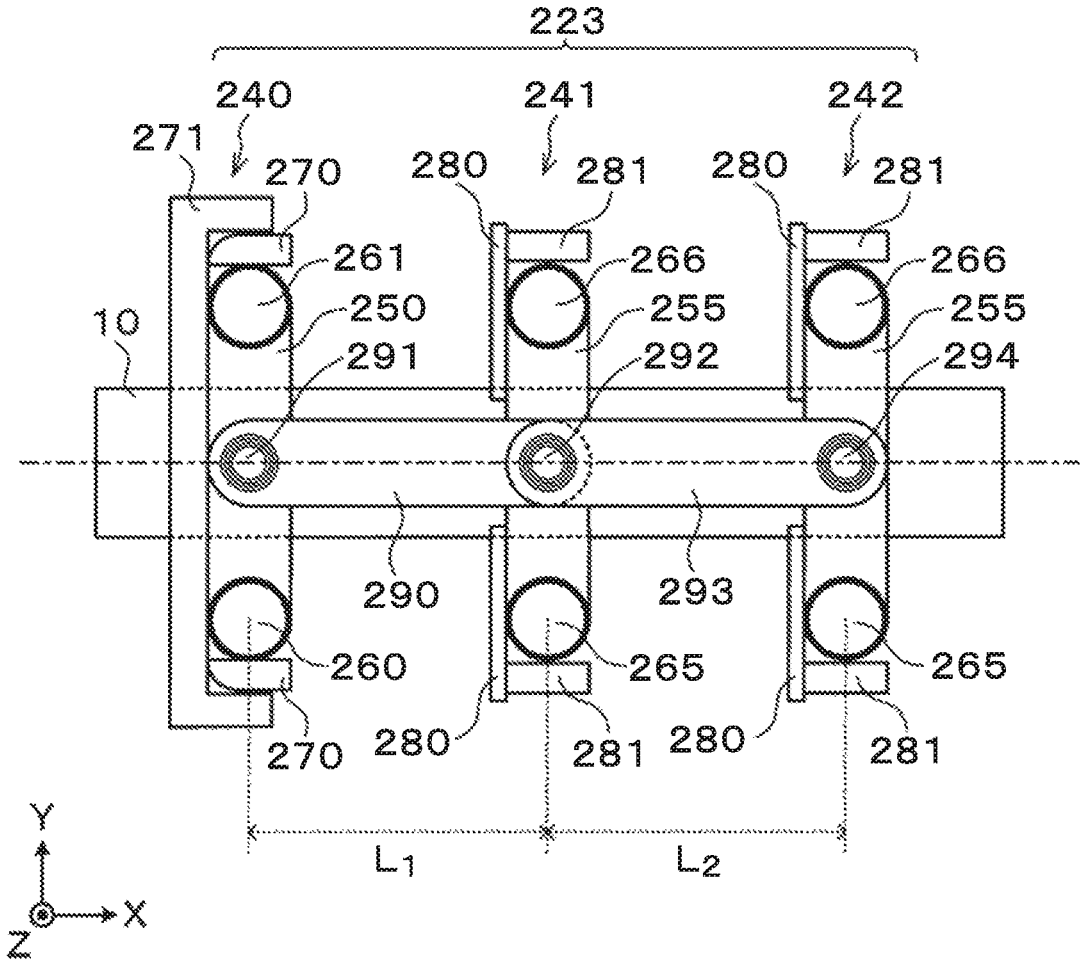
FIG. 9 is a schematic view showing a brief configuration of the second cooling apparatus according to the second embodiment in a state where the bending is not performed to the steel material.
Figure 10:
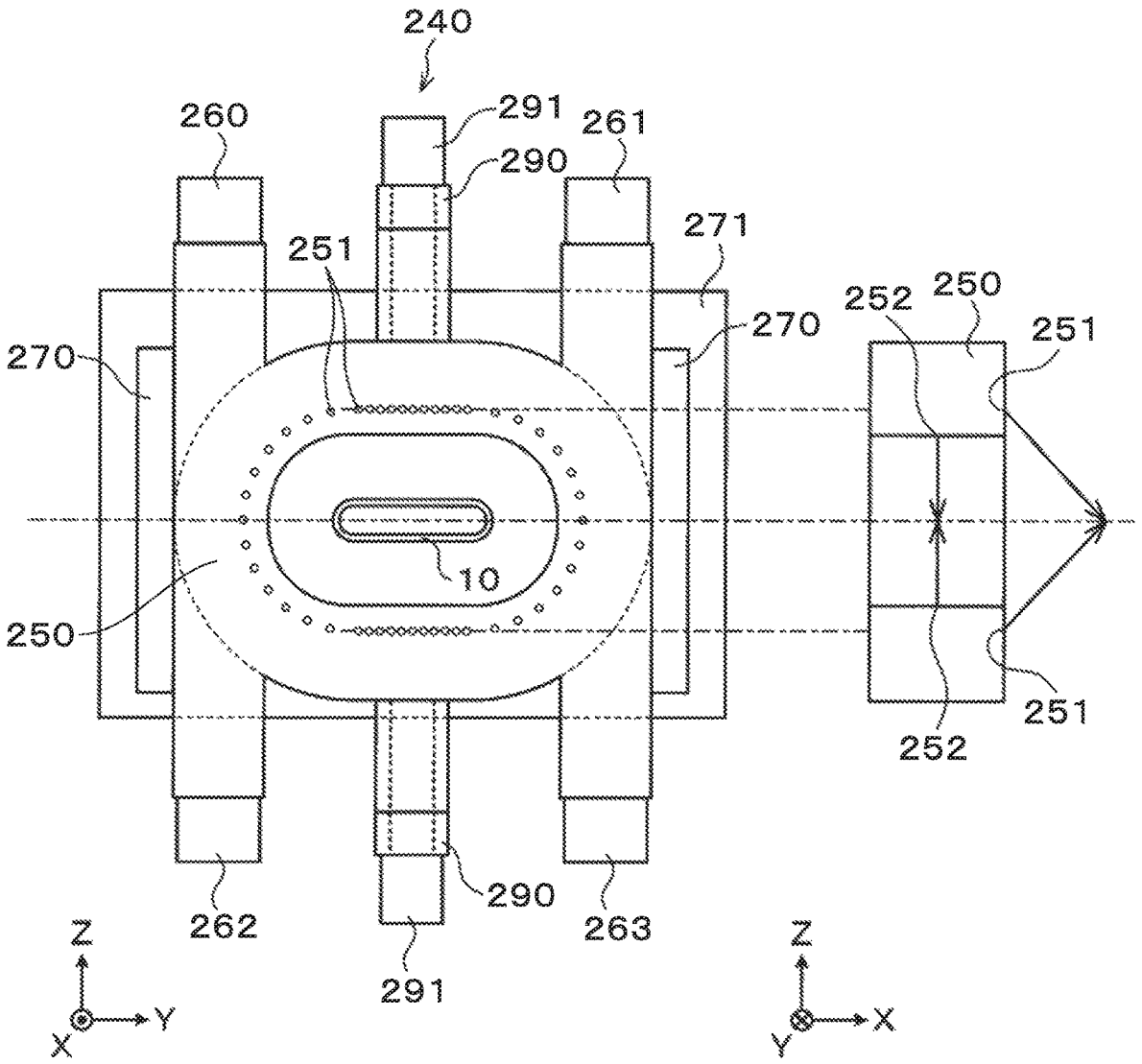
FIG. 10 is a schematic view showing a configuration of the first cooling mechanism according to the second embodiment.
Figure 11:
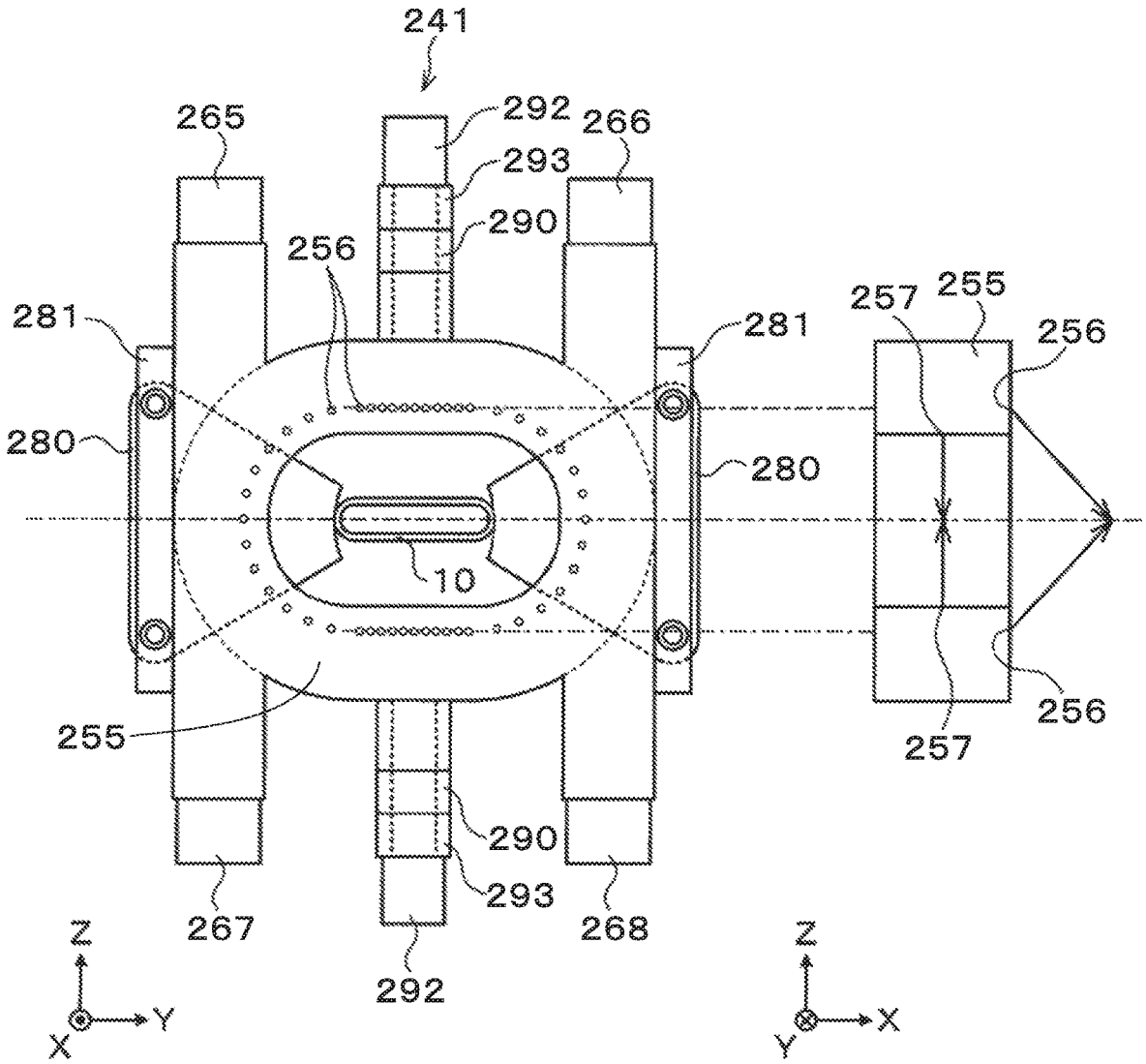
FIG. 11 is a schematic view showing a configuration of the second cooling mechanism according to the second embodiment.

FIG. 9 is a schematic view showing the configuration of the second cooling apparatus 223 according to the second embodiment in a state where the bending is not performed to the steel material 10. FIG. 10 is a schematic view showing a configuration of the first cooling mechanism 240 according to the second embodiment. FIG. 11 is a schematic view showing a configuration of the second cooling mechanism 241 according to the second embodiment.

As shown in FIG. 9, when viewed along the feeding direction of the steel material 10, the second cooling apparatus 223 includes the first cooling mechanism 240, the second cooling mechanism 241, and the third cooling mechanism 242, sequentially from the upstream side. The first cooling mechanism 240, the second cooling mechanism 241, and the third cooling mechanism 242 are the same as those according to the first embodiment in that the flow rates of the second cooling media 55 can be controlled independently of each other. The number of cooling mechanisms is not limited to an example according to the present embodiment, and can be optionally set.

As shown in FIG. 10, the first cooling mechanism 240 according to the present embodiment may have a header 250 that is annularly disposed around the steel material 10, and that supplies the second cooling medium 55. A plurality of ejection ports 251 for ejecting the second cooling medium 55 of a columnar jet are formed on a side surface in the header 250 in the feeding direction of the steel material 10. The second cooling media 55 ejected from the plurality of ejection ports 251 are ejected toward the downstream side.

In addition, a plurality of ejection ports 252 for ejecting the second cooling medium 55 of a columnar jet are also formed on an inner side surface of the header 250. The second cooling media 55 ejected from the plurality of ejection ports 252 are ejected in the vertical direction so that upper and lower surfaces of the steel material 10 are cooled.

Supply pipes 260 to 263 for supplying the second cooling medium 55 are connected to an outer circumferential portion of the header 250. The upper supply pipes 260 and 261 are connected to an upper surface of the header 250, and the lower supply pipes 262 and 263 are connected to a lower surface of the header 250. The reason for disposing a plurality of supply pipes 260 to 263 in a tangential direction of the header 250 is to stabilize the ejection of the second cooling medium 55 and to ensure a water amount.

For example, when viewed along the feeding direction of the steel material 10, the second cooling medium 55 is supplied to the header 250 from the upper supply pipe 260 and the lower supply pipe 263 which are located on a diagonal line of the header 250, and the supply of the second cooling medium 55 from the other upper supply pipe 261 and the other lower supply pipe 262 is stopped. In a case where the second cooling medium 55 is supplied as described above, the supplied second cooling medium 55 flows while swirling inside the annular header 250. Accordingly, the second cooling medium 55 can be uniformly ejected in the circumferential direction of the steel material 10 from the ejection ports 251 and 252 of the header 250.

When the second cooling medium 55 is supplied to the header 250, the second cooling medium 55 may be supplied from the upper supply pipe 261 and the lower supply pipe 262, and the supply of the second cooling medium 55 from the upper supply pipe 260 and the lower supply pipe 263 may be stopped. In order to ensure the water amount of the second cooling medium 55, the second cooling medium 55 may be supplied from all of the supply pipes 260 to 263.

As shown in FIG. 10, the header 250 is fixed to a second support member 271 via a first support member 270. Therefore, the second cooling medium 55 can be ejected without moving the first cooling mechanism 240.

As shown in FIG. 11, the second cooling mechanism 241 according to the present embodiment may have a header 255 that is annularly disposed around the steel material 10, and that supplies the second cooling medium 55. A plurality of ejection ports 256 for ejecting the second cooling medium 55 of a columnar jet are formed on a side surface of the header 255 in the feeding direction of the steel material 10. The second cooling media 55 ejected from the plurality of ejection ports 256 are ejected toward the downstream side. In addition, a plurality of ejection ports 257 for ejecting the second cooling medium 55 of a columnar jet are also formed on an inner side surface of the header 255. The second cooling media 55 ejected from the plurality of ejection ports 257 are ejected in the vertical direction so that upper and lower surfaces of the steel material 10 are cooled.

Supply pipes 265 to 268 for supplying the second cooling medium 55 are connected to an outer circumferential portion of the header 255. The upper supply pipes 265 and 266 are connected to an upper surface of the header 255, and the lower supply pipes 267 and 268 are connected to a lower surface of the header 255. The method of supplying the second cooling medium 55 to the header 255 from the supply pipes 265 to 268 is the same as the method of supplying the second cooling medium 55 to the header 250 from the supply pipes 260 to 263 in the above-described first cooling mechanism 240.

Although not shown, the third cooling mechanism 242 has the same configuration as that of the above-described second cooling mechanism 241.

A pair of contact members (contact portions) 280 and 280 are disposed on the upstream side of the header 255. The contact member 280 has a substantially triangular shape in a side view, and comes into contact with the outer shape of the steel material 10. For example, as the contact member 280, a material which has heat resistance without giving damage to the steel material 10 such as a fluororesin is used.

The contact member 280 is supported by a support member 281 attached to the header 255. The contact member 280 is detachable from the support member 281 since the contact member 280 is replaced in accordance with a size of the steel material 10 which is a workpiece.

In the second cooling mechanism 241 and the third cooling mechanism 242, the contact member 280 contacts with the steel material 10. Accordingly, the contact member 280 moves to follow the movement of the steel material 10 formed in a predetermined shape including the bent portion 11. In accordance with the movement of the contact member 280, the header 255 of the second cooling mechanism 241 and the header 255 of the third cooling mechanism 242 move to follow the movement of the steel material 10.

In this manner, even in a case where complicated bending is performed to the steel material 10, the collision position and the collision angle where the second cooling medium 55 ejected from the header 255 of the second cooling mechanism 241 and the header 255 of the third cooling mechanism 242 collides with the steel material 10 can be maintained constant. Therefore, without depending on a shape of the steel material 10, the second cooling medium 55 can be ejected to a circumferential surface including the outer side of the bent portion 11 of the steel material 10. Accordingly, it is possible to reduce the insufficient quenching when bending the steel material 10.

The connecting member (connecting portion) 290 which connects the center of the first cooling mechanism 240 and the center of the second cooling mechanism 241 to each other is disposed in the first cooling mechanism 240 and the second cooling mechanism 241 which are adjacent to each other as shown in FIG. 9. One end portion of the connecting member 290 is fixed to a stationary shaft 291 of the first cooling mechanism 240, and the connecting member 290 is pivotable around the stationary shaft 291. In addition, another end portion of the connecting member 290 is fixed to a stationary shaft 292 of the second cooling mechanism 241, and the connecting member 290 is pivotable around the stationary shaft 292.

As shown in FIGS. 10 and 11, the connecting member 290 and the stationary shafts 291 and 292 are disposed vertically above and below the steel material 10. As shown in FIG. 9, a center-to-center distance $L_1$ between the first cooling mechanism 240 and the second cooling mechanism 241 is maintained constant by the connecting member 290.

Similarly, the connecting member 293 which connects the center of the second cooling mechanism 241 and the center of the third cooling mechanism 242 to each other is also disposed in the second cooling mechanism 241 and the third cooling mechanism 242. One end portion of the connecting member 293 is fixed to a stationary shaft 292 of the second cooling mechanism 241, and the connecting member 293 is pivotable around the stationary shaft 292. In addition, another end portion of the connecting member 293 is fixed to a stationary shaft 294 of the third cooling mechanism 242, and the connecting member 293 is pivotable around the stationary shaft 294.

As shown in FIG. 11, the connecting member 293 and the stationary shafts 292 (and 294) are disposed vertically above and below the steel material 10. As shown in FIG. 9, a center-to-center distance $L_2$ between the second cooling mechanism 241 and the third cooling mechanism 242 is maintained constant by the connecting member 293.

In a case where the center-to-center distance $L_1$ between the first cooling mechanism 240 and the second cooling mechanism 241 or the center-to-center distance $L_2$ between the second cooling mechanism 241 and the third cooling mechanism 242 is not maintained constant, the collision position and the collision angle where the second cooling medium 55 collides with the steel material 10 are not constant. Consequently, there is a possibility that the second cooling medium 55 may not be properly ejected to a certain portion on the surface of the steel material 10. Therefore, there is a possibility that the insufficient quenching may appear on the steel material 10.

On the other hand, according to the present embodiment, the center-to-center distance $L_1$ between the first cooling mechanism 240 and the second cooling mechanism 241 and the center-to-center distance $L_2$ between the second cooling mechanism 241 and the third cooling mechanism 242 are maintained constant. Accordingly, the collision position and the collision angle where the second cooling medium 55 collides with the steel material 10 are maintained constant.

In addition, according to the present embodiment, even in a case where the steel material 10 is formed in a complicated shape, the second cooling medium 55 can be ejected to the circumferential surface of the outer side of the steel material 10.

For the above-described reason, according to the present embodiment, it is possible to reliably cool the outer side of the bent portion 11 which is less likely to be cooled in the related art. Therefore, it is possible to reduce the insufficient quenching when bending the steel material 10.

In addition, according to the present embodiment, the above-described secondary cooling can be realized without a need to provide a complicated drive mechanism.

In the second cooling medium 55 ejected from the first cooling mechanism 240 after cooling the steel material 10, the temperature of the second cooling medium 55 rises. Therefore, when the steel material 10 is cooled by the second cooling medium 55 ejected from the second cooling mechanism 241, if the second cooling medium 55 ejected from the first cooling mechanism 240 after cooling the steel material 10 is present, the steel material 10 cannot be effectively cooled.

However, the contact member 280 disposed in the second cooling mechanism 241 has a function to drain the second cooling medium 55 ejected from the first cooling mechanism 240. That is, the second cooling medium 55 ejected from the second cooling mechanism 241 can cool the steel material 10 without interfering with the second cooling medium 55 ejected from the first cooling mechanism 240. Therefore, according to the present embodiment, the steel material 10 can be effectively cooled by the second cooling medium 55 ejected from the second cooling mechanism 241.

Similarly, the contact member 280 of the third cooling mechanism 242 also has a function to drain the second cooling medium 55 ejected from the second cooling mechanism 241. That is, the second cooling medium 55 ejected from the third cooling mechanism 242 can cool the steel material 10 without interfering with the second cooling medium 55 ejected from the second cooling mechanism 241. Therefore, according to the present embodiment, the steel material 10 can be effectively cooled by the second cooling medium 55 ejected from the third cooling mechanism 242.

Therefore, according to the present embodiment, the secondary cooling of the steel material 10 can be effectively performed by the second cooling apparatus 223.

In the present embodiment, a mechanism in which each arrangement interval between the respective cooling mechanisms adjacent to each other is maintained constant and the arrangement of the respective cooling mechanisms is caused to follow a bent shape of the steel material 10 is referred to as a moving mechanism. In the second cooling apparatus 223 shown in FIGS. 9 to 11, the contact member 280 and the connecting members 290 and 293 configure the above-described moving mechanism. The moving mechanism which is constituted by the contact member 280 and the connecting members 290 and 293 moves the second cooling apparatus 223 in association with the movement of the steel material 10. Accordingly, the moving mechanism is a passive moving mechanism.

Second Embodiment, Cooling Method for Steel Material

Next, a cooling method for the steel material 10, which uses the second cooling apparatus 223 according to the present embodiment, will be described with reference to FIG. 12.

Figure 12:
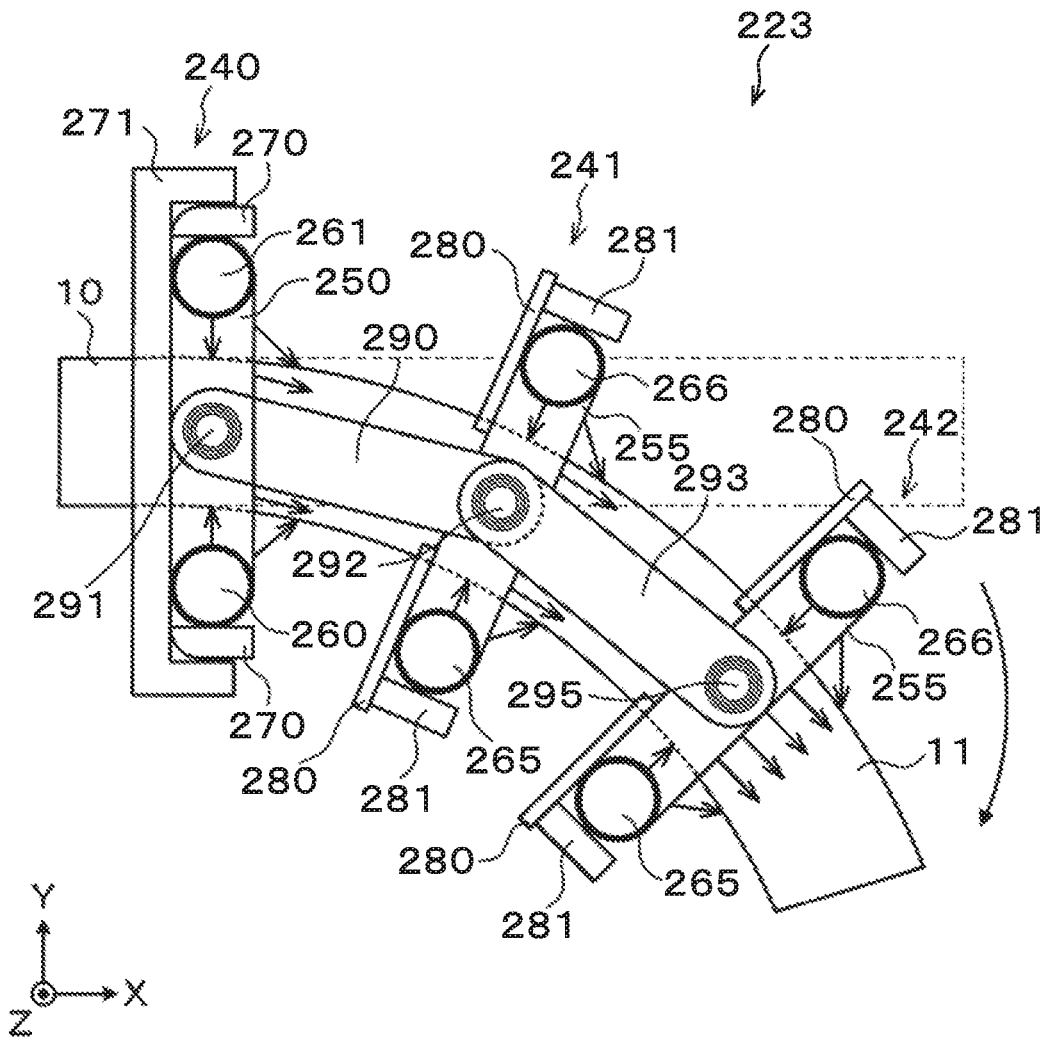
FIG. 12 is a schematic view showing a state where the steel material is cooled using the second cooling apparatus including a contact member and a connecting member according to the second embodiment.

FIG. 12 is a schematic view showing a state where the steel material 10 is cooled using the second cooling apparatus 223 including the contact member 280 and the connecting members 290 to 293 according to the second embodiment.

In the cooling method for the steel material 10 according to the present embodiment, as shown in FIG. 12, the center of the first cooling mechanism 240 and the center of the second cooling mechanism 241 are connected to each other by the connecting member 290. The center of the second cooling mechanism 241 and the center of the third cooling mechanism 242 are connected to each other by the connecting member 293. Therefore, when the second cooling media 55 are ejected to a plurality of locations along the feeding direction, each ejection interval in the feeding direction is maintained constant.

In addition, in the cooling method for the steel material 10 according to the present embodiment, as shown in FIG. 12, the contact member 280 disposed in the second cooling mechanism 241 and the third cooling mechanism 242 contacts with the steel material 10. In this manner, in the cooling method for the steel material 10 according to the present embodiment, the arrangement of the collision position where the second cooling medium 55 collides with the steel material 10 is caused to follow the predetermined shape of the steel material 10 which is obtained by the contact member 280 coming into contact with the steel material 10 (moving process).

According to the cooling method for the steel material 10 in the present embodiment, when the second cooling media 55 are ejected to the plurality of locations along the feeding direction, each ejection interval in the feeding direction is maintained constant. The arrangement of the collision position where the second cooling medium 55 collides with the steel material 10 is caused to follow the predetermined shape of the steel material 10. Therefore, it is possible to reduce the insufficient quenching of the steel material 10.

Second Embodiment, Modification Example 1

Next, Modification Example 1 of the second embodiment will be described with reference to FIG. 13.

Figure 13:
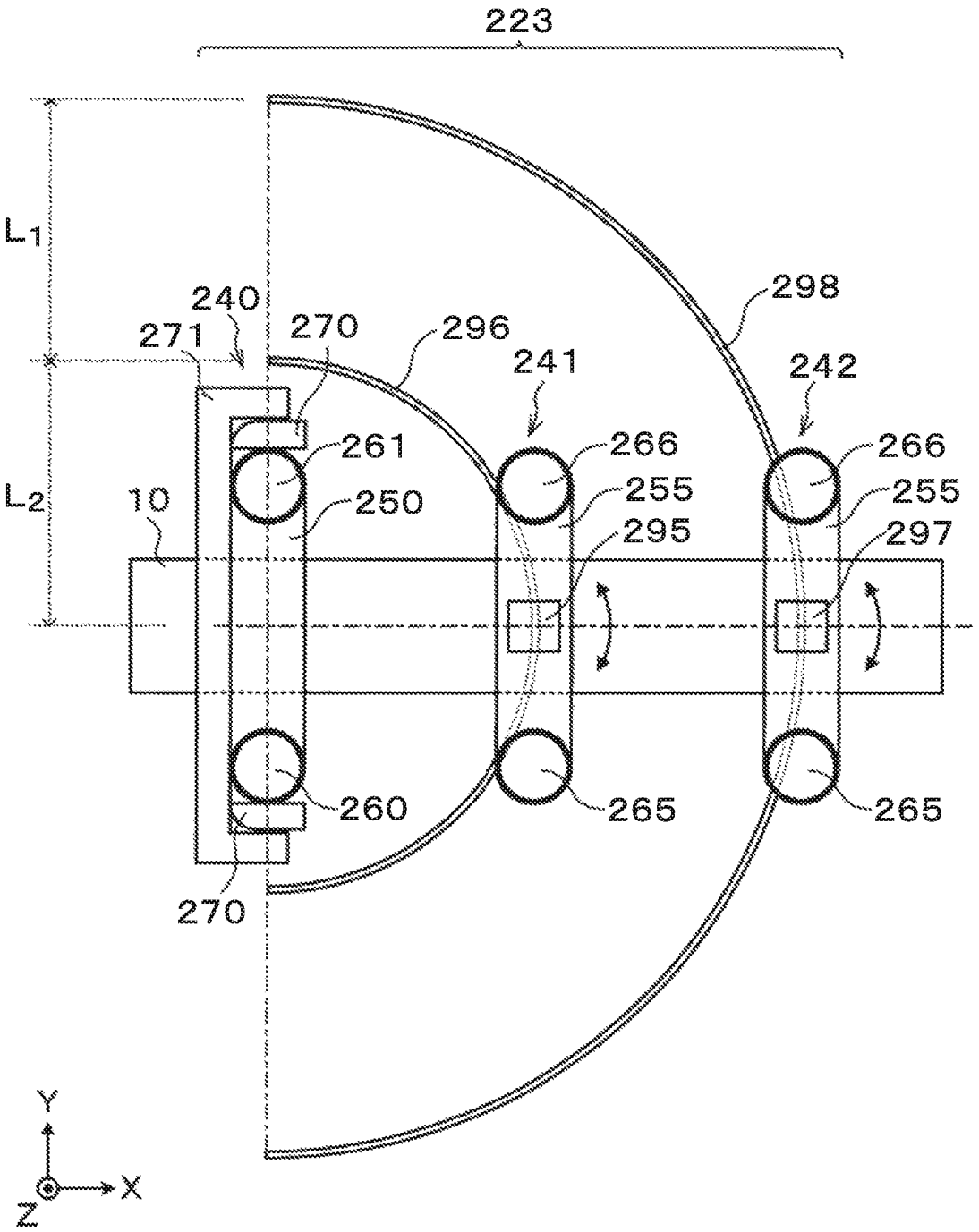
FIG. 13 is a schematic view showing a configuration of a second cooling apparatus according to Modification Example 1 of the second embodiment.

FIG. 13 is a schematic view showing a configuration of the second cooling apparatus according to Modification Example 1 of the second embodiment.

In the above-described second cooling apparatus 223, the contact member 280 and the connecting members 290 to 293 are disposed as the moving mechanism. However, the configuration of the moving mechanism is not limited thereto.

As shown in FIG. 13, the second cooling mechanism 241 has a drive unit 295 internally equipped with a motor, for example. The drive unit 295 is attached to a guide (guide portion) 296 which extends concentrically with the center of the first cooling mechanism 240. In accordance with the predetermined shape which is scheduled to apply to the steel material 10, the drive unit 295 moves the header 255 of the second cooling mechanism 241 along the guide 296. That is, the guide 296 regulates a moving direction of the second cooling mechanism 241.

Similarly, the third cooling mechanism 242 has a drive unit 297 internally equipped with a motor, for example. The drive unit 297 is attached to a guide (guide portion) 298 which extends concentrically with the center of the first cooling mechanism 240. In accordance with the predetermined shape which is scheduled to apply to the steel material 10, the drive unit 297 moves the header 255 of the third cooling mechanism 242 along the guide 298. That is, the guide 298 regulates a moving direction of the third cooling mechanism 242.

According to the present modification example, in accordance with the predetermined shape which is scheduled to apply to the steel material 10, the drive unit 295 moves the header 255 of the second cooling mechanism 241 along the guide 296. In accordance with the predetermined shape which is scheduled to apply to the steel material 10, the drive unit 297 moves the header 255 of the third cooling mechanism 242 along the guide 298. In this manner, the collision position and the collision angle where the second cooling medium 55 ejected from the header 255 of the second cooling mechanism 241 and the header 255 of the third cooling mechanism 242 collides with the steel material 10 can be maintained constant.

For the above-described reason, according to present modification example, similarly to the second embodiment, it is possible to reliably cool the outer side of the bent portion 11 which is less likely to be cooled in the related art. Therefore, it is possible to reduce the insufficient quenching when bending the steel material 10.

In Modification Example 1 of the second embodiment, the drive units 295 and 297 and the guides 296 and 298 constitute the moving mechanism. The moving mechanism which is constituted by the drive units 295 and 297 and the guides 296 and 298 moves the second cooling apparatus 223 in accordance with a bent shape of the steel material 10 which is programmed. Therefore, the moving mechanism is an active moving mechanism.

The guides 296 and 298 are not limited to a rail-shaped guide, and can adopt various configurations. For example, the guide may guide the second cooling mechanism 241 and the third cooling mechanism 242 by vertically suspending both of these from above.

In addition, in the present modification example, the guides 296 and 298 may be omitted, and the drive units 295 and 297 may be controlled so that the center-to-center distances $L_1$ and $L_2$ are respectively constant in accordance with the bent shape of the steel material 10 which is programmed. However, in order to reliably maintain the center-to-center distances $L_1$ and $L_2$ to be constant, it is preferable to provide the guides 296 and 298.

Second Embodiment, Modification Example 2

Next, Modification Example 2 of the second embodiment will be described with reference to FIG. 14.

Figure 14:
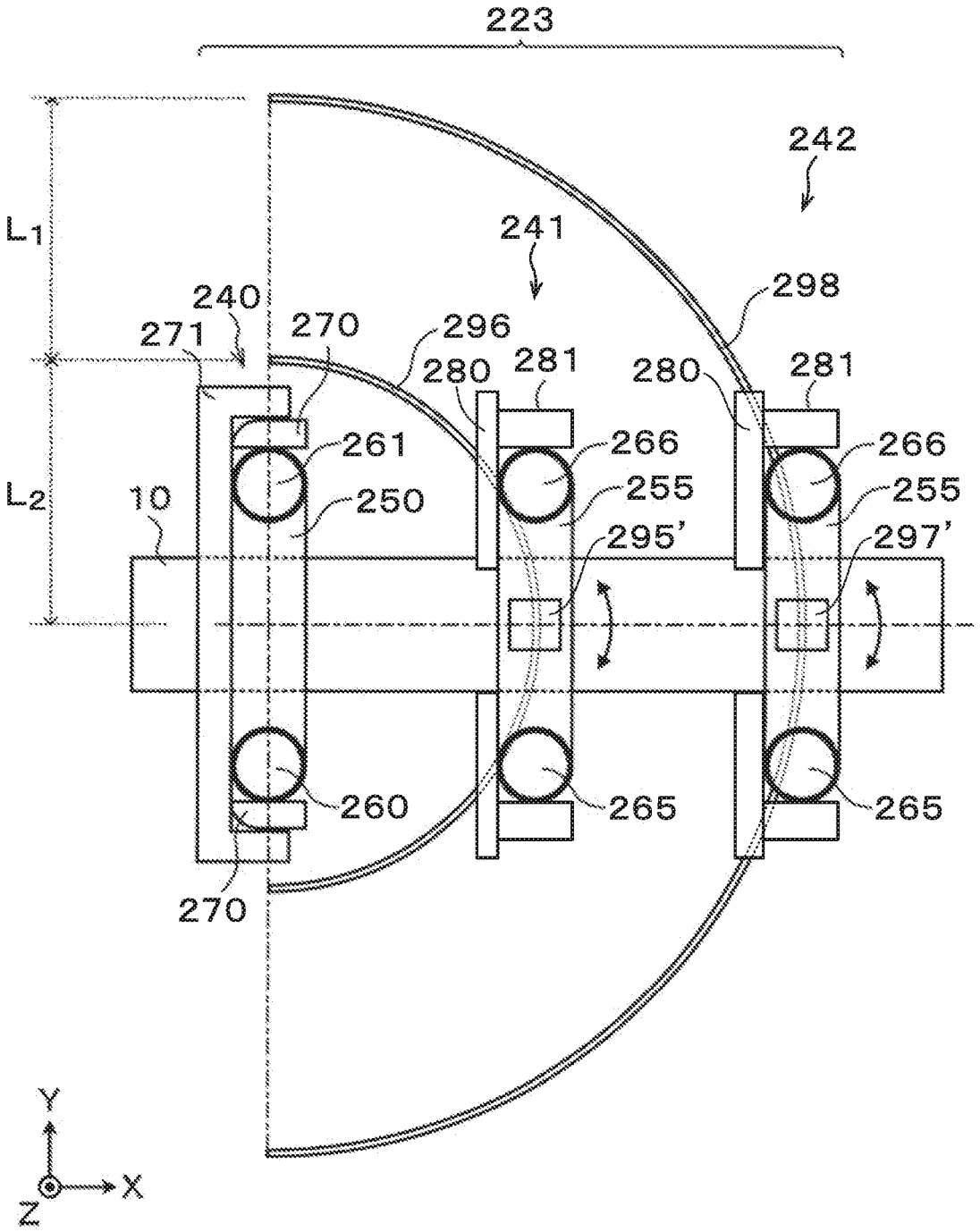
FIG. 14 is a schematic view showing a configuration of a second cooling apparatus according to Modification Example 2 of the second embodiment.

FIG. 14 is a schematic view showing a configuration of the second cooling apparatus 223 according to Modification Example 2 of the second embodiment.

As the moving mechanism, the second cooling apparatus 223 shown in FIG. 14 includes the contact member 280 and the guides 296 and 298.

In the present modification example, the header 255 of the second cooling mechanism 241 is movable along the guide 296 by a sliding member 295'. Similarly, the header 255 of the third cooling mechanism 242 is movable along the guide 298 by a sliding member 297'.

In addition, in the present modification example, the second cooling mechanism 241 and the third cooling mechanism 242 include the contact member 280. Accordingly, the header 255 of the second cooling mechanism 241 and the header 255 of the third cooling mechanism 242 move to follow the movement of the steel material 10.

In this manner, even in a case where complicated bending is performed to the steel material 10, the collision position and the collision angle where the second cooling medium 55 ejected from the header 255 of the second cooling mechanism 241 and the header 255 of the third cooling mechanism 242 collides with the steel material 10 can be maintained constant. Therefore, without depending on a bent shape of the steel material 10, the second cooling medium 55 can be ejected to the circumferential surface of the outer side of the bent portion 11 of the steel material 10. Accordingly, it is possible to reduce the insufficient quenching when the bending for the steel material 10.

The moving mechanism according to the present modification example moves the second cooling apparatus 223 in association with the movement of the steel material 10. Accordingly, the moving mechanism is a passive moving mechanism.

Third Embodiment, Cooling Apparatus for Steel Material

Next, the cooling apparatus for the steel material 10 according to a third embodiment will be described with reference to FIGS. 15 to 17.

Figure 15:
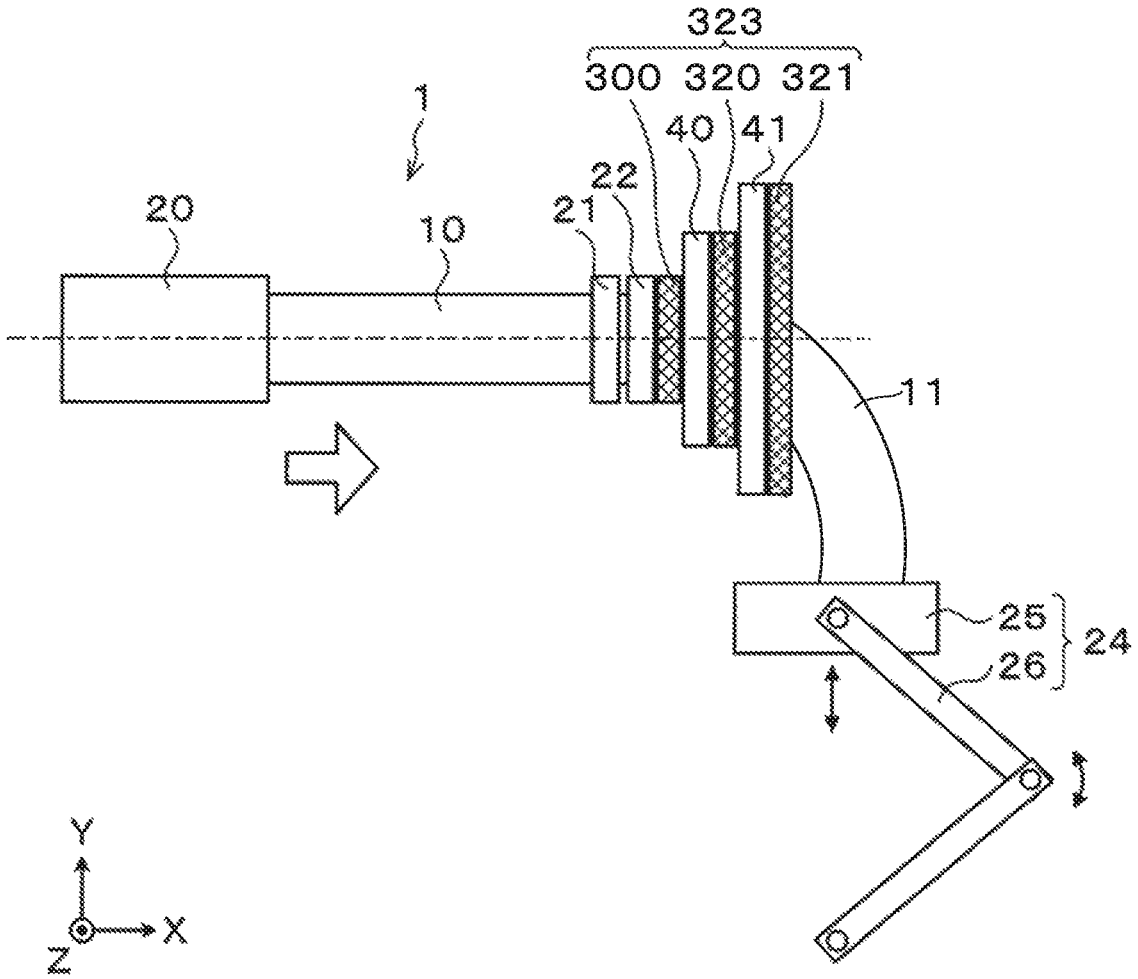
FIG. 15 is a schematic view showing a bending device for a steel material which includes a cooling apparatus for a steel material according to a third embodiment.

FIG. 15 is a schematic view showing a bending device including the cooling apparatus for the steel material 10 according to the third embodiment. FIG. 16 is a schematic view showing a configuration of a first draining mechanism 300. FIG. 17 is a schematic view showing a state where the steel material 10 is cooled using the cooling apparatus for the steel material 10 according to the third embodiment.

As shown in FIG. 15, the first cooling mechanism 40 located at the most upstream position in the second cooling apparatus 323 according to the present embodiment has the first draining mechanism 300 which ejects draining water. The first draining mechanism 300 is disposed between the first cooling apparatus 22 and the first cooling mechanism 40 located at the most upstream position of the second cooling apparatus 23. The first draining mechanism 300 drains the first cooling medium 35 ejected toward the downstream side from the first cooling apparatus 22, at a further upstream position from the collision position where the second cooling medium 55 ejected from the first cooling mechanism 40 collides with the steel material 10.

Figure 16:
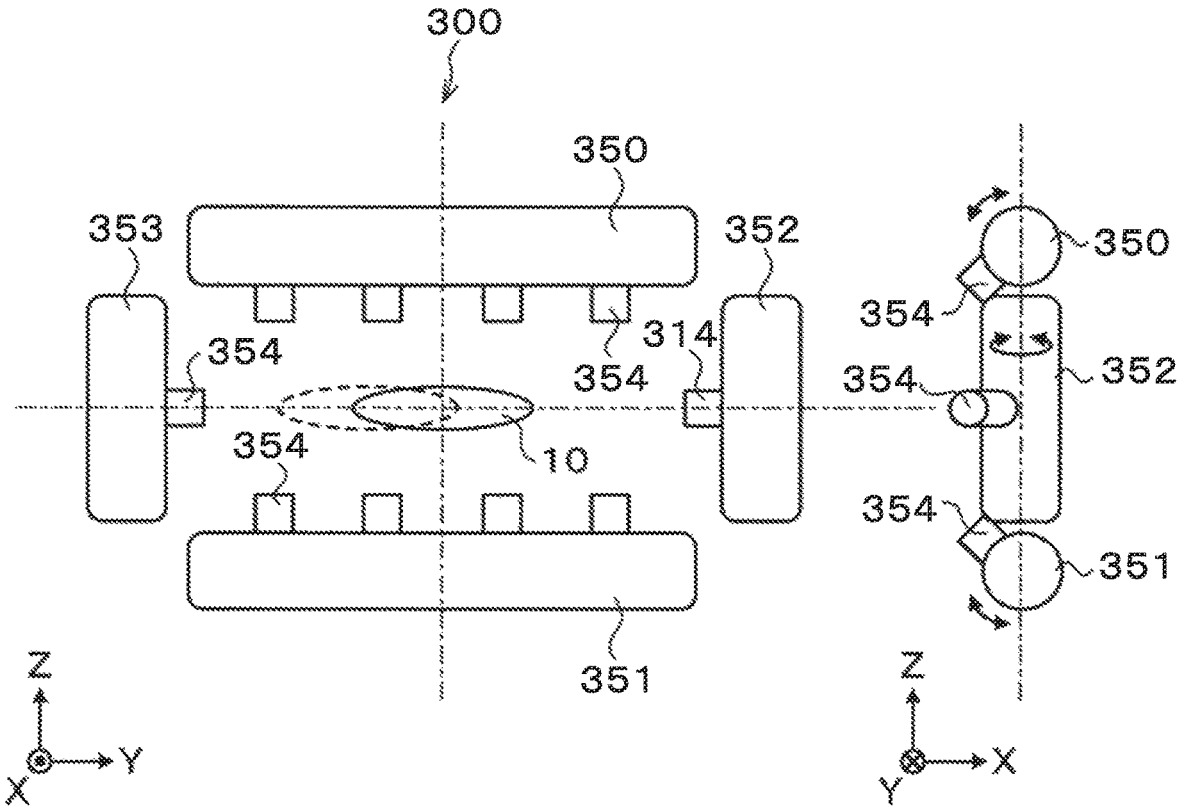
FIG. 16 is a schematic view showing a configuration of a first draining mechanism.

As shown in FIG. 16, the first draining mechanism 300 has headers 350 to 353 which are disposed dividedly in the circumferential direction of the steel material 10 and which supply the draining water. The upper header 350 is disposed vertically above the steel material 10, and the lower header 351 is disposed vertically below the steel material 10. The lateral headers 352 and 353 are respectively disposed laterally in the horizontal direction of the steel material 10. The respective headers 350 to 353 can control the flow velocity or the water amount of the draining water independently of each other. Without being limited to the number according to the present embodiment, the number of the headers 350 to 353 can be optionally set.

The respective headers 350 to 353 have a spray nozzle 354. For example, as the spray nozzle 354, a flat nozzle, a full cone nozzle, or an oval nozzle is used. Without being limited to the number shown in FIG. 16, the number of the spray nozzles 354 disposed in the respective headers 350 to 353 can be optionally set.

Figure 17:
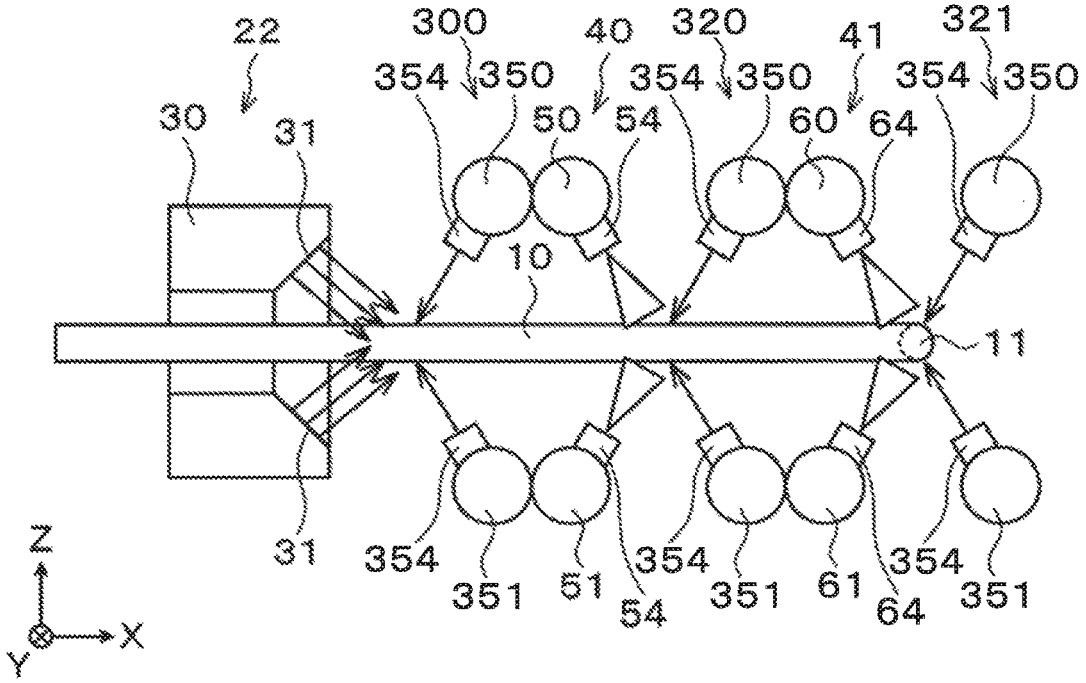
FIG. 17 is a schematic view showing a state where the steel material is cooled using the cooling apparatus according to the third embodiment.

As shown in FIG. 17, each spray nozzle 354 of the respective headers 350 to 353 is disposed in a direction in which the draining water from the spray nozzle 354 is ejected to the upstream side, that is, to the first cooling apparatus 22 side. Then, the first cooling medium 35 is drained by the draining water ejected from the first draining mechanism 300, and hence, does not flow to the downstream side. Therefore, without receiving the influence of the first cooling medium 35 ejected from the first cooling apparatus 22, the second cooling medium 55 ejected from the first cooling mechanism 40 can collide with the steel material 10. Accordingly, since the second cooling apparatus 323 includes the first draining mechanism 300, the first cooling mechanism 40 can effectively perform the secondary cooling on the steel material 10.

In addition, as shown in FIG. 15, the second cooling apparatus 323 may further include a second draining mechanism 320 and a third draining mechanism 321 which eject the draining water. The second draining mechanism 320 is disposed between the first cooling mechanism 40 and the second cooling mechanism 41. The third draining mechanism 321 is disposed on the downstream side from the second cooling mechanism 41.

Since the second cooling apparatus 323 includes the second draining mechanism 320, the second cooling medium 55 ejected from the first cooling mechanism 40 is drained by the draining water ejected from the second draining mechanism 320. Thus, the second cooling medium 55 does not flow to the downstream side. Therefore, without receiving the influence of the second cooling medium 55 ejected from the first cooling mechanism 40, the second cooling medium 55 ejected from the second cooling mechanism 41 can collide with the steel material 10. Accordingly, since the second cooling apparatus 323 includes the second draining mechanism 320, the second cooling mechanism 41 can effectively perform the secondary cooling on the steel material 10.

The second cooling medium 55 ejected from the second cooling mechanism 41 is drained by the draining water ejected from the third draining mechanism 321. Therefore, it is possible to prevent that the second cooling medium 55 ejected from the second cooling mechanism 41 from being scattered beyond the steel material 10.

The second draining mechanism 320 and the third draining mechanism 321 have the same configuration as that of the first draining mechanism 300.

Third Embodiment, Cooling Method for Steel Material

Next, a cooling method for the steel material 10 according to a third embodiment will be described with reference to FIG. 17.

(First Draining Process)

The cooling method for the steel material 10 according to the present embodiment has a first draining process of draining the first cooling medium 35 ejected toward the downstream side, at the upstream position from the collision position where the second cooling medium 55 ejected from the first cooling mechanism 40 located at the most upstream position in the second cooling apparatus 23 collides with the steel material 10.

Since the cooling method for the steel material 10 according to the present embodiment has the first draining process.

The second cooling medium 55 ejected from the first cooling mechanism 40 can collide with the steel material 10 without receiving the influence of the first cooling medium 35 ejected from the first cooling apparatus 22. Therefore, the first cooling mechanism 40 can effectively perform the secondary cooling to the steel material 10.

(Second Draining Process)

The cooling method for the steel material 10 according to the present embodiment may further have a plurality of second draining processes of draining the second cooling medium 55 flowing toward the downstream side, at the downstream position from the collision position where one of the second cooling media 55 collides with the steel material 10.

Since the cooling method for the steel material 10 according to the present embodiment has the plurality of second draining processes, the second cooling medium 55 ejected from the second cooling mechanism 41 can collide with the steel material 10 without receiving the influence of the second cooling medium 55 ejected from the first cooling mechanism 40. In addition, since the cooling method for the steel material 10 according to the present embodiment has the plurality of second draining processes, it is possible to drain the second cooling medium 55 ejected from the second cooling mechanism 41. Therefore, the second cooling medium 55 can be prevented from being scattered beyond the steel material 10.

Accordingly, since the cooling method for the steel material 10 according to the present embodiment has the second draining process, the second cooling mechanism 41 can effectively perform the secondary cooling on the steel material 10.

Fourth Embodiment, Cooling Apparatus for Steel Material

Next, the cooling apparatus for the steel material 10 according to a fourth embodiment will be described with reference to FIG. 18.

Figure 18:
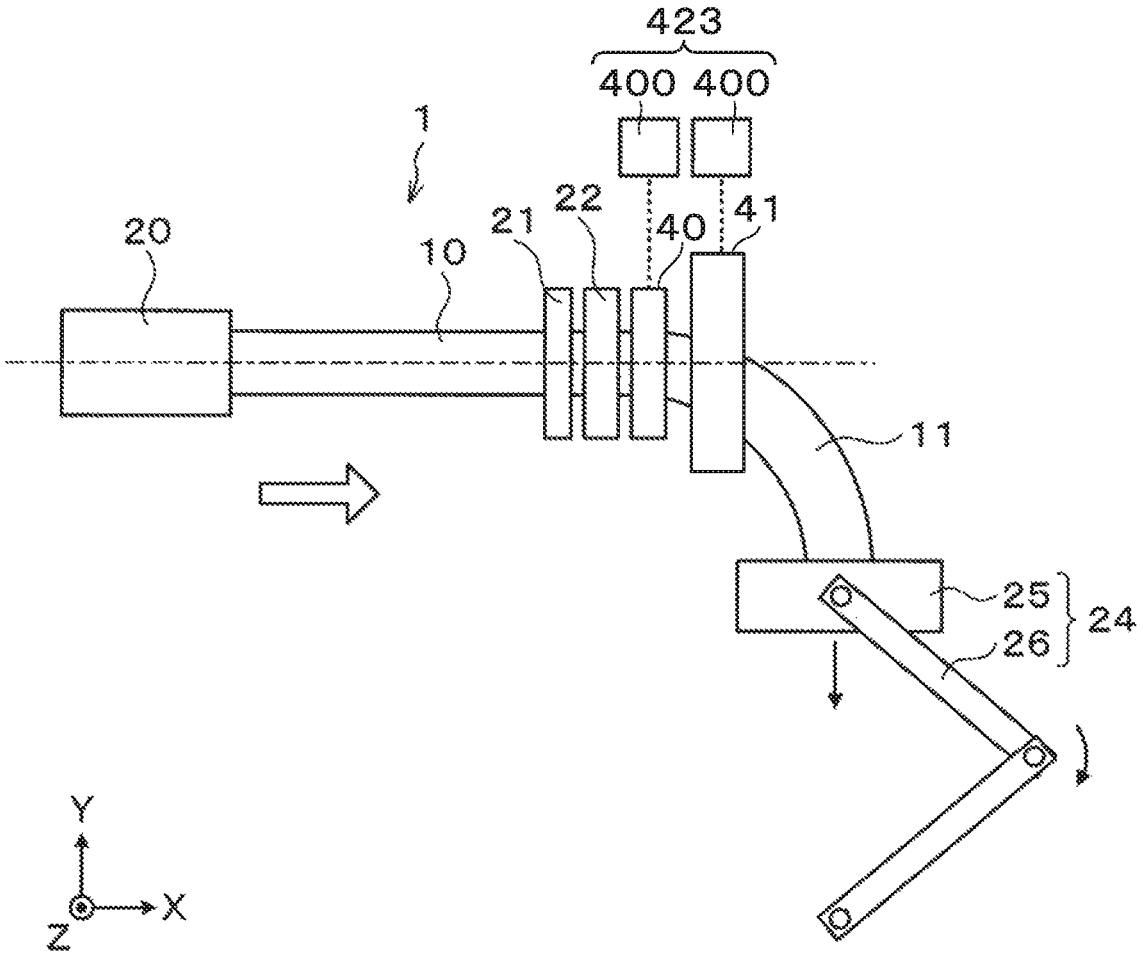
FIG. 18 is a schematic view showing a configuration of a bending device including a cooling apparatus according to a fourth embodiment.

FIG. 18 is a schematic view showing a configuration of the bending device for the steel material 10 which includes the cooling apparatus for the steel material 10 according to the fourth embodiment.

In a second cooling apparatus 423 according to the present embodiment, the second cooling medium 55 ejected from the first cooling mechanism 40 and the second cooling mechanism 41 is controlled by a control unit 400 shown in FIG. 18. For example, the control unit 400 is a computer. The control unit 400 has a program stored therein to control the flow velocity or water amount density of the second cooling medium 55.

The control unit 400 controls the second cooling medium 55 so that the flow velocity of the second cooling medium 55 is 2 to 30 m/sec and the water amount density is 5 to 100 $m^3/m^2/min$. Through the cooling using the second cooling medium 55, the steel material 10 is cooled to below the martensitic transformation finish temperature Mf, or to approximately room temperature, for example. Specifically, the steel material 10 is cooled to the room temperature to 300° C., for example.

In the present embodiment, the water amount density ($m^3/m^2/min$) represents a water amount per unit area and unit time on a cooled material's surface serving as a region with which cooling water collides.

Hitherto, a case has been described where the control unit 400 is disposed in the second cooling apparatus 423. However, the control unit 400 may be disposed in the first cooling apparatus 22, and the control unit 400 may control the first cooling medium 35 ejected from the first cooling apparatus 22. In a case where the control unit 400 controls the first cooling medium 35, the control unit 400 controls the first cooling medium 35 so that the flow velocity of the first cooling medium 35 is 2 to 8 m/sec and the water amount density is 20 to 80 $m^3/m^2/min$.

Since the control unit 400 controls the second cooling medium 55 as described above, the second cooling medium 55 ejected from the first cooling mechanism 40 can drain the first cooling medium 35 ejected from the first cooling apparatus 22.

In order to efficiently cool the steel material 10, that is, in order to increase a heat transfer amount to the steel material 10, it is generally necessary to reduce a thickness of a temperature boundary layer. In the present embodiment, the second cooling medium 55 ejected from the first cooling mechanism 40 drains the first cooling medium 35. Accordingly, it is possible to prevent the first cooling medium 35 whose temperature rises from flowing to the downstream side. In this manner, it is possible to prevent the temperature boundary layer from growing in the second cooling medium 55 ejected from the first cooling mechanism 40. Therefore, it is possible to effectively cool the steel material 10.

In addition, since the control unit 400 controls the second cooling medium 55 as described above, the second cooling medium 55 ejected from the second cooling mechanism 41 can drain the second cooling medium 55 ejected from the first cooling mechanism 40. In this manner, for the reason similar to the above-described reason, it is possible to prevent the temperature boundary layer from growing in the second cooling medium 55 ejected from the second cooling mechanism 41. Therefore, the steel material 10 can be more effectively cooled.

In order to stably and efficiently cool the steel material 10 in a nuclear boiling region during the secondary cooling, it is necessary to ensure the water amount density of the second cooling medium 55. From a viewpoint of ensuring the water amount density, a lower limit value of the flow velocity of the second cooling medium 55 is set to 2 m/sec.

On the other hand, an upper limit value of the flow velocity of the second cooling medium 55 is not particularly limited from a viewpoint that the first cooling medium 35 is drained and the secondary cooling is properly performed on the steel material 10. However, from a viewpoint of maintenance and economic feasibility of the second cooling apparatus 23, it is preferable that the water amount of the second cooling medium 55 is reduced as much as possible, and it is preferable that the flow velocity of the second cooling medium 55 is as slow as possible. Therefore, the upper limit value of the flow velocity of the second cooling medium 55 is set to 30 m/sec.

In the present embodiment, the flow velocity of the second cooling medium 55 indicates a flow velocity at an exit of the spray nozzles 54 and 64.

Fourth Embodiment, Cooling Method for Steel Material

Next, a cooling method for the steel material 10 according to a fourth embodiment will be described with reference to FIG. 19.

Figure 19:
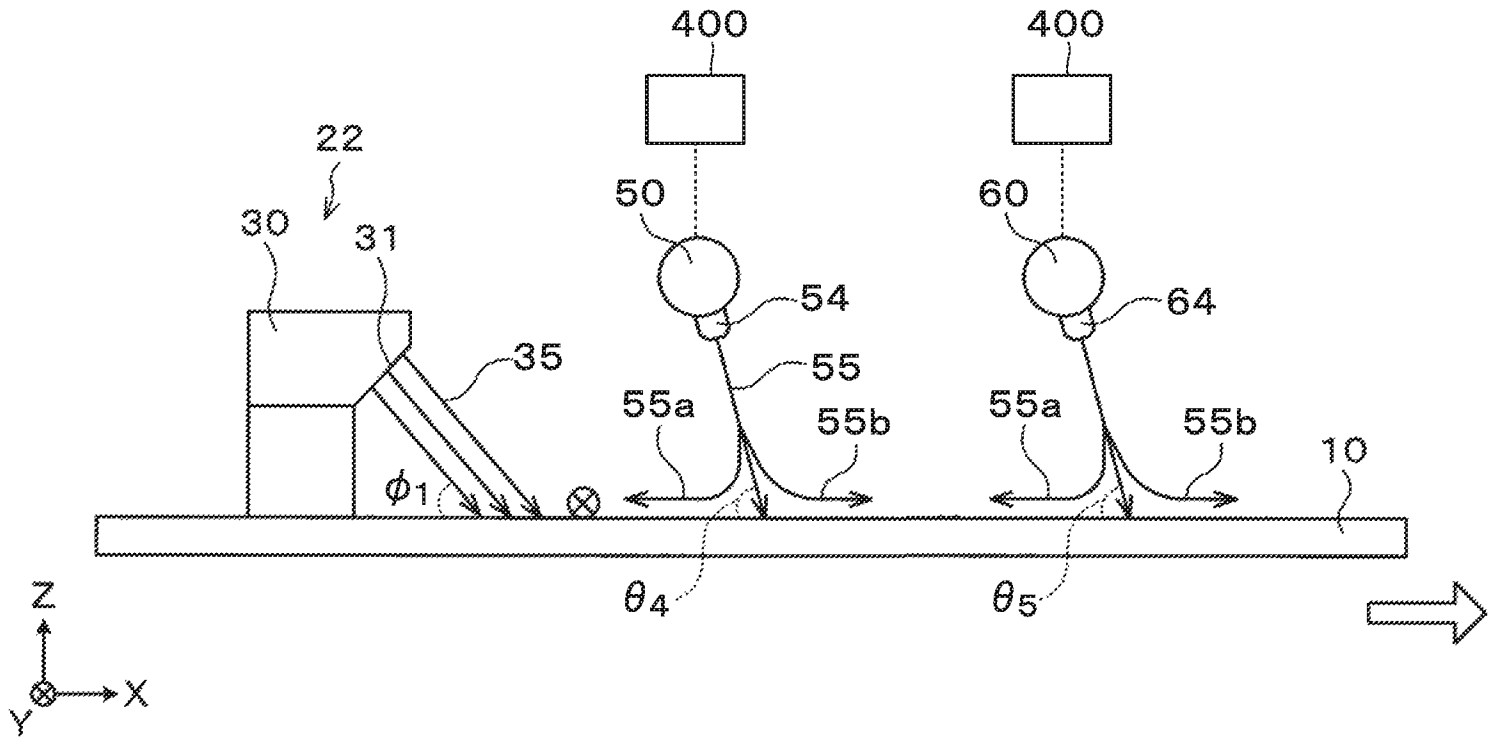
FIG. 19 is a schematic view showing a state where an upper surface of the steel material is cooled using the cooling apparatus according to the fourth embodiment.

FIG. 19 is a schematic view showing a state where an upper surface of the steel material 10 is cooled using the cooling apparatus for the steel material 10 according to the fourth embodiment.

As shown in FIG. 19, the first cooling medium 35 ejected from the first cooling apparatus 22 collides with the steel material 10 at a collision angle $Ø_1$. After being used in performing the primary cooling on the steel material 10, the first cooling medium 35 flows toward the downstream side.

The second cooling medium 55 ejected from the spray nozzle 54 of the upper header 50 of the first cooling mechanism 40 collides with the steel material 10 at a collision angle $\theta_4$. As shown in FIG. 19, the control unit 400 is disposed in the first cooling mechanism 40 and the second cooling mechanism 41, and controls both of these so that the flow velocity of the second cooling medium 55 is 2 to 30 m/sec and the water amount density is 5 to 100 $m^3/m^2/min$.

A second cooling medium 55*a* as a portion of the second cooling medium 55 ejected to the steel material 10 from the spray nozzle 54 flows to the upstream side so as to drain the first cooling medium 35, and the remaining second cooling medium 55*b* flows to the downstream side so as to be used in performing the secondary cooling on the steel material 10. According to the cooling method, the first cooling medium 35 is drained. Therefore, the second cooling medium 55*b* to be used in performing the secondary cooling does not receive the influence of the first cooling medium 35, and the secondary cooling can be properly performed on the steel material 10.

The second cooling medium 55*a* is used in draining the first cooling medium 35, and is discharged laterally from the steel material 10 together with the first cooling medium 35. Accordingly, the second cooling medium 55*a* does not flow to the upstream side (heating apparatus 21 side).

The second cooling medium 55 ejected from the spray nozzle 64 of the upper header 60 of the second cooling mechanism 41 collides with the steel material 10 at a collision angle $\theta_5$. The second cooling medium 55*a* as a portion of the second cooling medium 55 ejected to the steel material 10 from the spray nozzle 64 flows to the upstream side, and drains the second cooling medium 55*b* ejected from the spray nozzle 54. The remaining second cooling medium 55*b* flows to the downstream side, and is used in performing the secondary cooling on the steel material 10. According to the cooling method, the second cooling medium 55*b* whose temperature rises can be prevented from flowing to the downstream side. Therefore, it is possible to efficiently perform the secondary cooling on the steel material 10 using the second cooling medium 55.

In the present embodiment, the flow velocity of the second cooling medium 55 is controlled to be 2 to 30 m/sec. Accordingly, the second cooling medium 55*a* as a portion of the second cooling medium 55 ejected to the steel material 10 flows to the upstream side, and drains the first cooling medium 35. The remaining second cooling medium 55*b* is used in performing the secondary cooling on the steel material 10.

Accordingly, without receiving the influence of the first cooling medium 35, the second cooling medium 55*b* can cool the steel material 10. Therefore, the second cooling medium 55*b* can be ejected to the outer circumferential surface of the outer side of the bent portion 11 of the steel material 10. In this manner, it is possible to reduce the insufficient quenching on the steel material 10, and it is possible to bend the steel material 10 properly. Moreover, the second cooling medium 55 is provided with a function to drain the first cooling medium 35 and a function to perform the secondary cooling on the steel material 10. Therefore, a mechanism for draining the first cooling medium 35 is not needed, thereby leading to economically excellent effect.

Even in a case where the lower surface of the steel material 10 is cooled, the same cooling method is used. That is, even when the lower surface of the steel material 10 is cooled, the flow velocity of the second cooling medium 55 ejected from the spray nozzle 54 of the lower header 51 of the first cooling mechanism 40 and the spray nozzle 64 of the lower header 61 of the second cooling mechanism 41 is set to 2 to 30 msec. In this manner, the second cooling medium 55 can properly cool the lower surface of the steel material 10. It is preferable that the flow velocity of the second cooling medium 55 ejected from the spray nozzle 54 of the lateral headers 52 and 53 of the first cooling mechanism 40 and the spray nozzle 64 of the lateral headers 62 and 63 of the second cooling mechanism 41 is set to 2 to 30 m/sec similarly to the second cooling medium 55 ejected from the upper headers 50 and 60 and the lower headers 51 and 61.

In accordance with a cooled state of the steel material 10, the control unit 400 may control not only the flow velocity of the second cooling medium 55, but also the water amount density of the second cooling medium 55 or the collision angle between the second cooling medium 55 and the steel material 10. Since the control unit 400 can control the water amount density of the second cooling medium 55 or the collision angle between the second cooling medium 55 and the steel material 10, even in a case where complicated bending is performed to the steel material 10, the steel material 10 can be cooled without causing the insufficient quenching.

Fourth Embodiment, Modification Example 1

Next, Modification Example 1 of the fourth embodiment will be described with reference to FIGS. 20 to 22.

Figure 20:
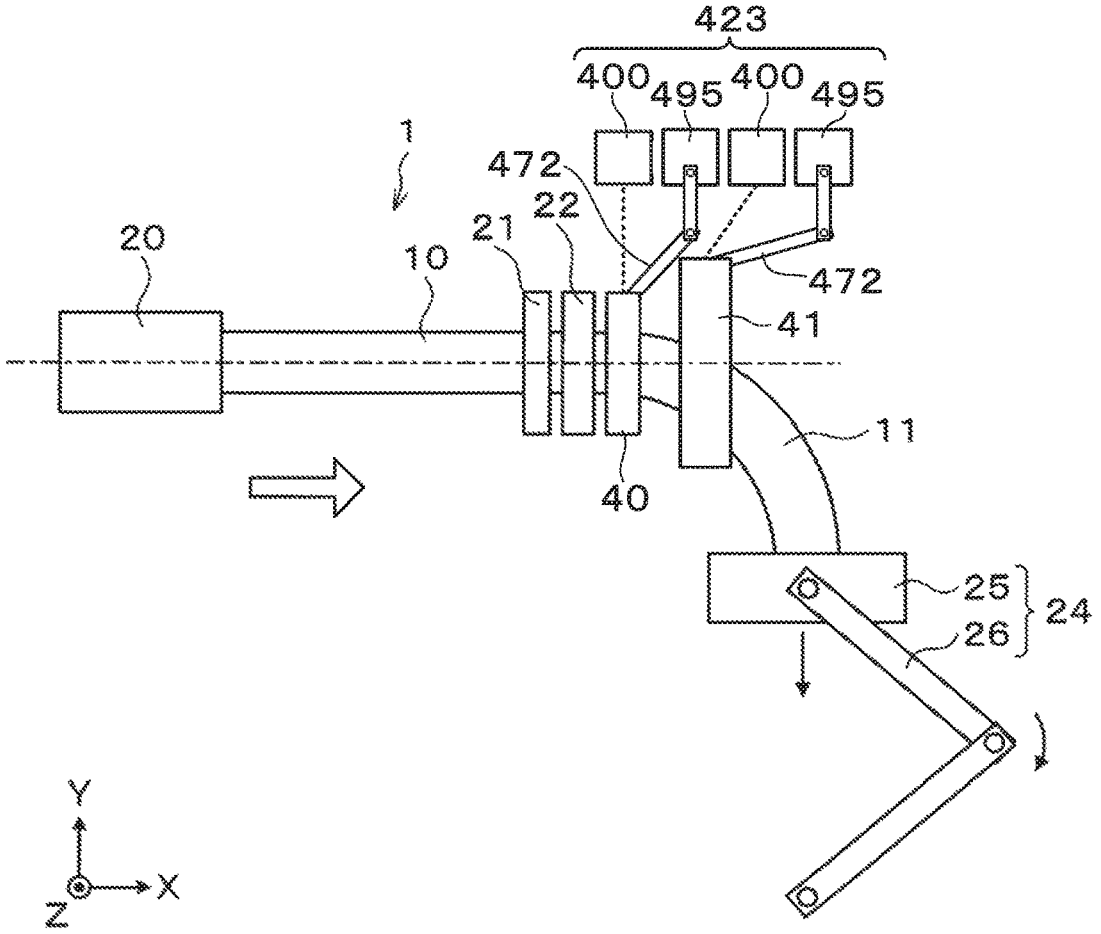
FIG. 20 is a schematic view showing a configuration of a bending device including a cooling apparatus according to Modification Example 1 of the fourth embodiment.

FIG. 20 is a schematic view showing a configuration of the bending device 1 for the steel material 10, which includes the cooling apparatus for the steel material 10 according to Modification Example 1 of the fourth embodiment. FIG. 21 is a schematic view showing a configuration of the first cooling mechanism 40 and a moving mechanism 470 according to Modification Example 1 of the fourth embodiment. FIG. 22 is a schematic view showing a state where the steel material 200 is cooled using a cooling method for a steel material 200 in the related art.

Figure 21:
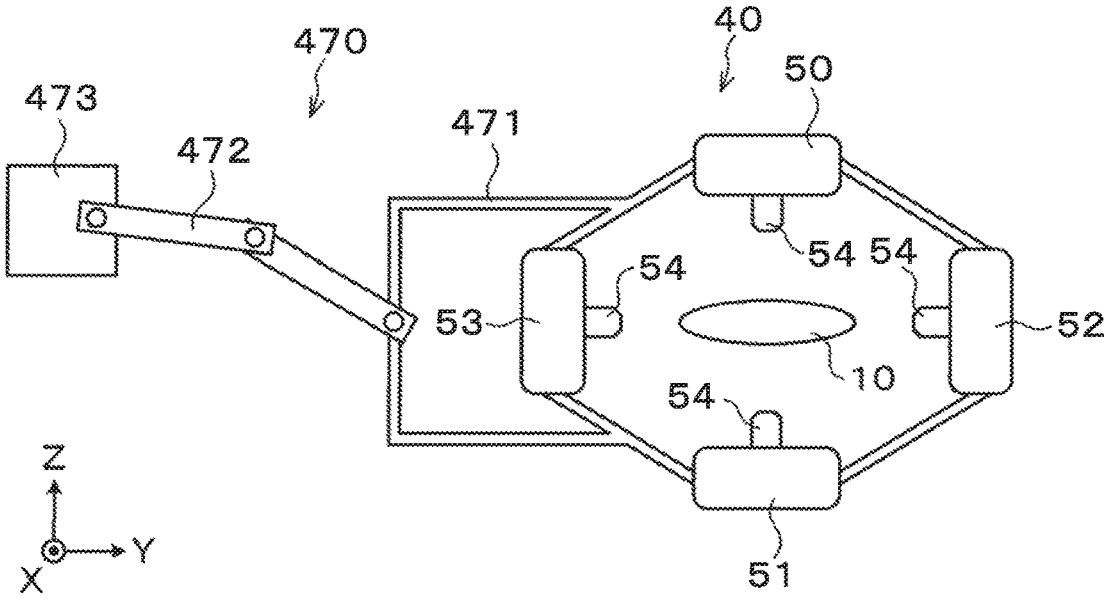
FIG. 21 is a schematic view showing a configuration of the first cooling mechanism and a moving mechanism according to Modification Example 1 of the fourth embodiment.

As shown in FIGS. 20 and 21, the second cooling apparatus 423 according to the present modification example further includes the moving mechanism 470 which moves the spray nozzles 54 and 64. The moving mechanism 470 has a support member 471 which supports the headers 50 to 53 and 60 to 63, a drive arm 472 which moves the support member 471 (the headers 50 to 53 and 60 to 63, and the spray nozzles 54 and 64), and a drive unit 495 which drives the drive arm 472. A configuration of the moving mechanism 470 is not limited to the present modification example. As long as the spray nozzles 54 and 64 can be moved, any optional configuration can be adopted.

Although not shown, the moving mechanism 470 disposed in the second cooling mechanism 41 has the same configuration as that of the moving mechanism 470 disposed in the first cooling mechanism 40.

Figure 22:
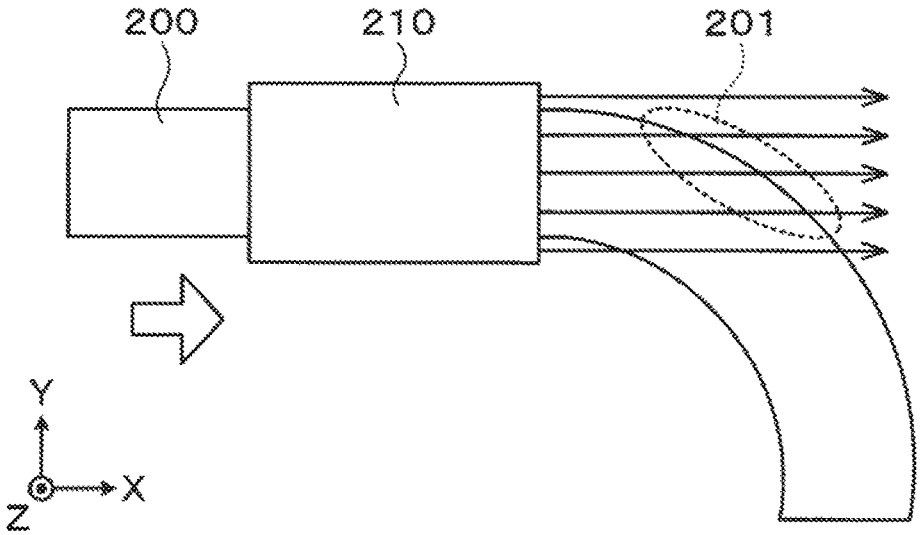
FIG. 22 is a schematic view showing a state where a steel material is cooled using a cooling method for a steel material in Patent Document 1.

Here, for example, in a case of using the cooling method for the steel material 200 in the related art disclosed in Patent Document 1, that is, in a case where the cooling apparatus 210 cools the heat-processed steel material 200 as shown in FIG. 22, the cooling medium ejected from the cooling apparatus 210 moves straight forward in the feeding direction (X-axis direction in FIG. 22) of the steel material 200.

Accordingly, the cooling medium does not collide with a circumferential surface 201 (region surrounded by a dotted line in FIG. 22) on the outer side (protruding side) of the bent portion of the steel material 200. Therefore, the circumferential surface of the outer side of the bent portion 201 is not sufficiently cooled, thereby causing the insufficient quenching on the steel material 200. In particular, in a case where complicated bending is performed and in a case where the feeding speed of the steel material 200 is fast, the insufficient quenching is likely to appear on the steel material 200.

On the other hand, the moving mechanism 470 according to the present embodiment can move the spray nozzles 54 and 64 disposed in the headers 50 to 53 and 60 to 63 so as to follow the movement of the steel material 10 formed in a predetermined shape including the bent portion 11 by the bending apparatus 24. Therefore, even if the steel material 10 is processed into a complicated shape, the second cooling medium 55 can be ejected to the circumferential surface of the outer side of the bent portion 11 of the steel material 10. As a result, it is possible to properly cool the circumferential surface of the outer side of the bent portion 11. Accordingly, it is possible to reduce the insufficient quenching on the steel material 10.

Furthermore, the spray nozzles 54 and 64 can be moved by the moving mechanism 470. Accordingly, it is possible to adjust a collision angle at which the second cooling medium 55 ejected from the spray nozzles 54 and 64 collides with the steel material 10.

The collision angle between the second cooling medium 55 and the steel material 10 is adjusted to 45 degrees or smaller. In this manner, it is possible to prevent the second cooling medium 55 colliding with the steel material 10 from returning to the upper headers 50 and 60 side or the lower headers 51 and 61 side. In addition, since the collision angle between the second cooling medium 55 and the steel material 10 is adjusted, the momentum of the second cooling medium 55 in the feeding direction of the steel material 10 can be greater than the momentum of the first cooling medium 35 in the feeding direction of the steel material 10.

Therefore, since the second cooling apparatus 423 includes the moving mechanism 470, the secondary cooling can be more effectively performed on the steel material 10.

In addition, in the embodiment shown in FIG. 3, in order to correspond to a case where the steel material 10 is formed in various shapes, the width of the upper header 50 and the lower header 51 is increased, and the plurality of spray nozzles 54 are respectively disposed in the upper header 50 and the lower header 51.

On the other hand, according to the present modification example, as shown in FIG. 21, the width of the upper header 50 and the lower header 51 can be decreased, and the number of spray nozzles 54 can be reduced. Without being limited to the number shown in the present embodiment, the number of spray nozzles 54 can be optionally set. For example, the lateral headers 52 and 53 and the spray nozzle 54 disposed in the lateral headers 52 and 53 may be omitted.

In FIG. 21, the control unit 400 is omitted.

Furthermore, since the second cooling apparatus 423 includes the moving mechanism 470, the spray nozzle 54 disposed in the headers 50 to 53 can follow the movement of the steel material 10. Accordingly, the second cooling medium 55 ejected from the spray nozzle 54 can reliably collide with the steel material 10. Therefore, it is possible to reduce the water amount of the second cooling medium 55 needed to cool the steel material 10 to a predetermined temperature. In this manner, it is possible to improve maintenance service and economic feasibility of the second cooling apparatus 423.

Fourth Embodiment, Modification Example 2

Next, Modification Example 2 of the fourth embodiment will be described with reference to FIG. 23.

Figure 23:
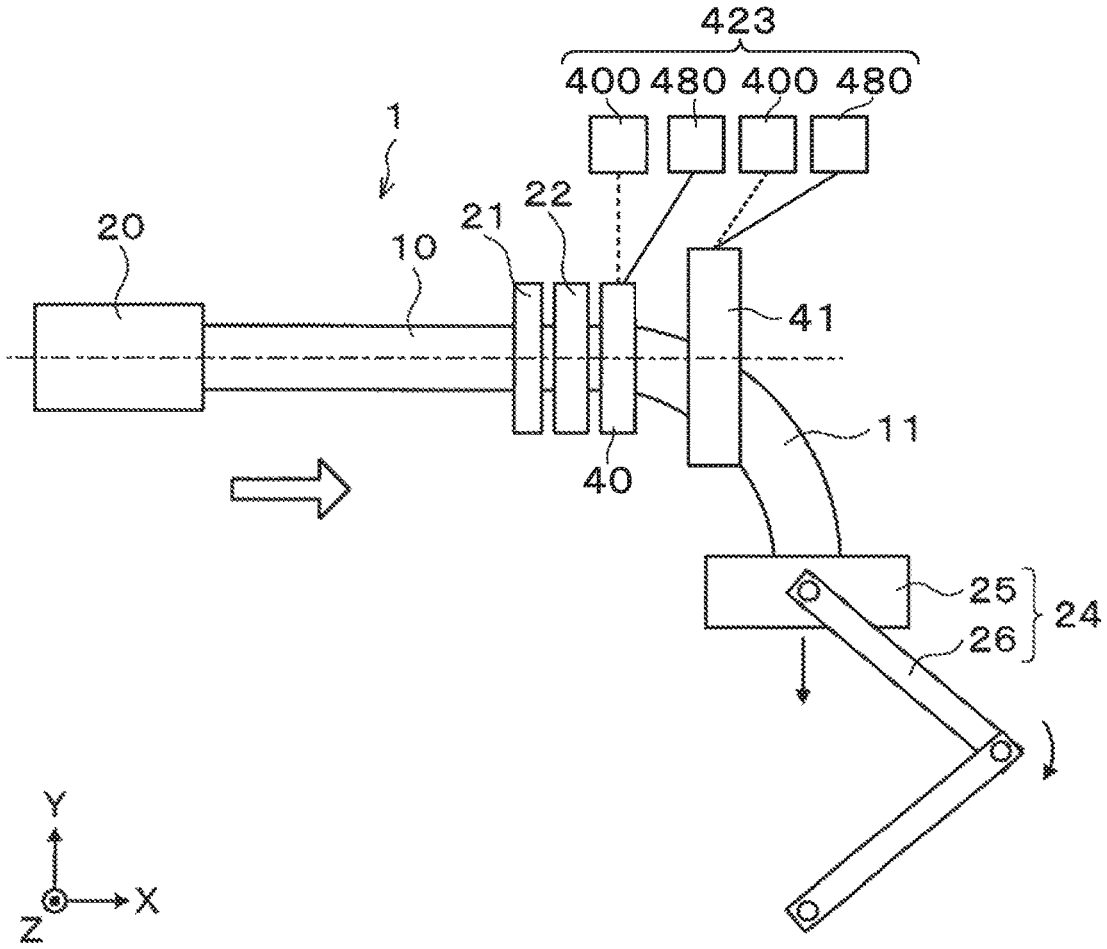
FIG. 23 is a schematic view showing a configuration of a bending device including a second cooling apparatus according to Modification Example 2 of the fourth embodiment.

FIG. 23 is a schematic view showing a configuration of the bending device 1 for the steel material 10 which includes the second cooling apparatus 423 according to Modification Example 2 of the fourth embodiment.

As shown in FIG. 23, in addition to the control unit 400, the first cooling mechanism 40 and the second cooling mechanism 41 according to the present embodiment further includes a pulsation providing mechanism 480 which provides the second cooling medium 55 with a pulsation. A configuration of the pulsation providing mechanism 480 can employ a known configuration, and is not limited to a specific configuration.

In order to perform the secondary cooling on the steel material 10 in a nuclear boiling region, it is generally necessary to agitate the second cooling medium 55 on the steel material 10 and to properly provide the second cooling medium 55 with latent heat from the steel material 10. In a case where the pulsation providing mechanism 480 provides the pulsation for the second cooling medium 55 ejected to the steel material 10, the second cooling medium 55 is agitated, and thus, the secondary cooling can be more reliably performed on the steel material 10 in the nuclear boiling region using the second cooling medium 55. Therefore, the secondary cooling can be more effectively performed on the steel material 10.

Fifth Embodiment, Cooling Apparatus for Steel Material

Next, the cooling apparatus for the steel material 10 according to a fifth embodiment will be described with reference to FIGS. 24 and 25.

Figure 24:
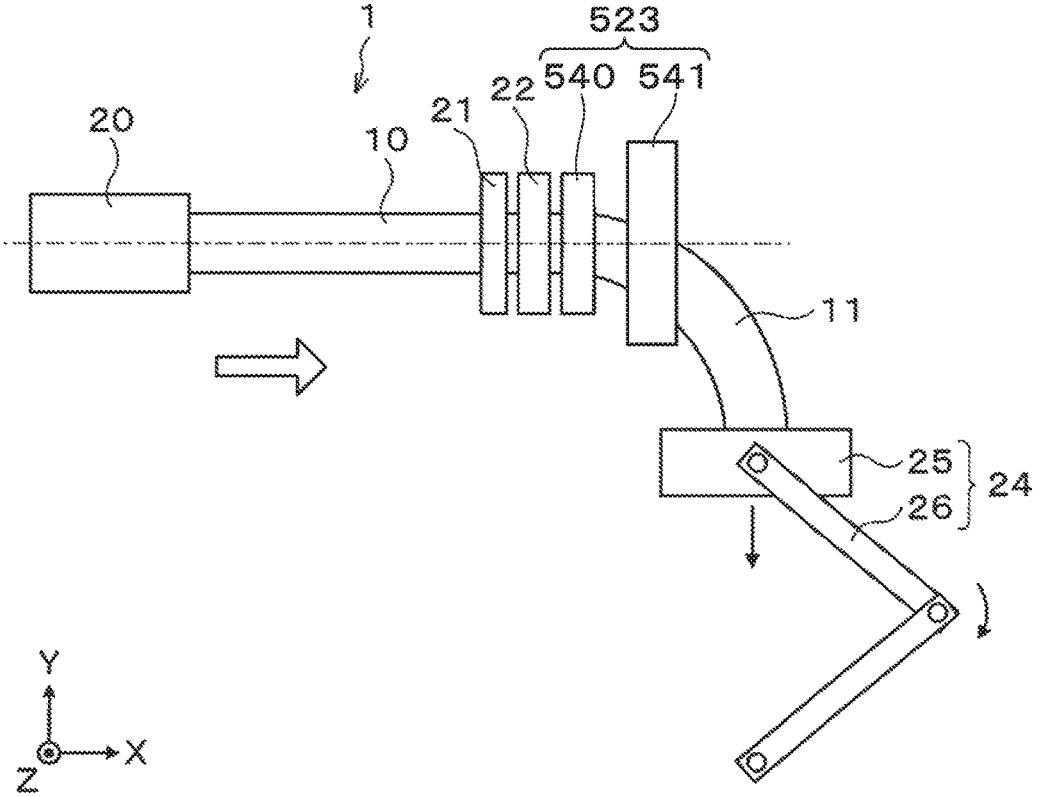
FIG. 24 is a schematic view showing a configuration of a bending device including a cooling apparatus according to a fifth embodiment.

FIG. 24 is a schematic view showing a configuration of the bending device 1 including the cooling apparatus for the steel material 10 according to the fifth embodiment. FIG. 25 is a schematic view showing a configuration of a first cooling mechanism 540 according to the fifth embodiment.

As shown in FIG. 24, the bending device 1 for the steel material 10 according to the present embodiment includes a second cooling apparatus 523 instead of the second cooling apparatus 23.

Figure 25:
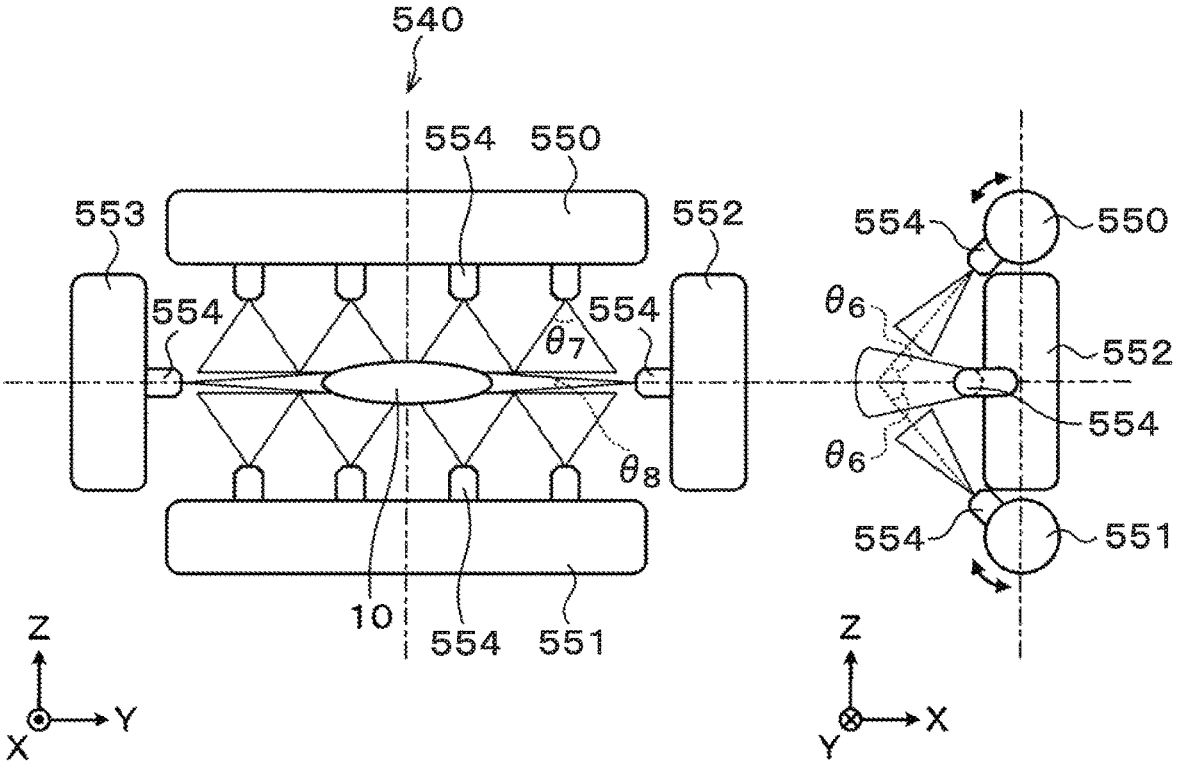
FIG. 25 is a schematic view showing a configuration of the first cooling mechanism according to the fifth embodiment.

As shown in FIG. 25, a spray nozzle 554 of respective headers 550 to 553 of a first cooling mechanism 540 according to the present embodiment is disposed in a direction in which the second cooling medium 55 ejected from the spray nozzle 554 is ejected to the upstream side in the feeding direction.

It is preferable to dispose the spray nozzle 554 of the upper header 550 and the lower header 551 in a direction in which a collision angle $\theta_6$ at which the second cooling medium 55 ejected from the spray nozzle 554 collides with the steel material 10 is 60 degrees or smaller. When the collision angle $\theta_6$ is set to 60 degrees or smaller, it is possible to prevent the second cooling medium 55 colliding with the steel material 10 from reversely flowing and returning to the upper header 550 side or the lower header 551 side.

It is preferable to dispose the spray nozzle 554 of the respective headers 550 to 553 at a position where the second cooling media 55 ejected from the respective spray nozzles 554 do not cross each other until the second cooling medium 55 ejected from the spray nozzle 554 reaches the steel material 10.

Furthermore, in order to enable the second cooling medium 55 to properly cool the steel material 10 even in a case where bending is performed to the steel material 10 into a complicated shape, it is preferable that an ejection angle $\theta_7$ of the second cooling medium 55 ejected from the spray nozzle 54 of the upper header 550 and the lower header 551 and an ejection angle $\theta_8$ of the second cooling medium 55 ejected from the spray nozzle 54 of the lateral headers 552 and 553 are as wide as possible within a range in which the second cooling media 55 do not cross each other as described above.

However, considering maintenance service and economic feasibility of the second cooling apparatus 523, it is preferable that the ejection angles $\theta_7$ and $\theta_8$ are respectively set to approximately 30 to 90 degrees. Furthermore, in a case where a moving mechanism 570 is disposed in the second cooling apparatus 523 as will be described later, it is preferable that the ejection angles $\theta_7$ and $\theta_8$ are respectively set to approximately 30 to 50 degrees. However, in a case where a cooling surface of the steel material 10 is narrow, the ejection angles $\theta_7$ and $\theta_8$ may be 10 to 30 degrees.

The configuration of the first cooling mechanism 540 has been described with reference to FIG. 25. A second cooling mechanism 541 also has the same configuration.

Figure 27:
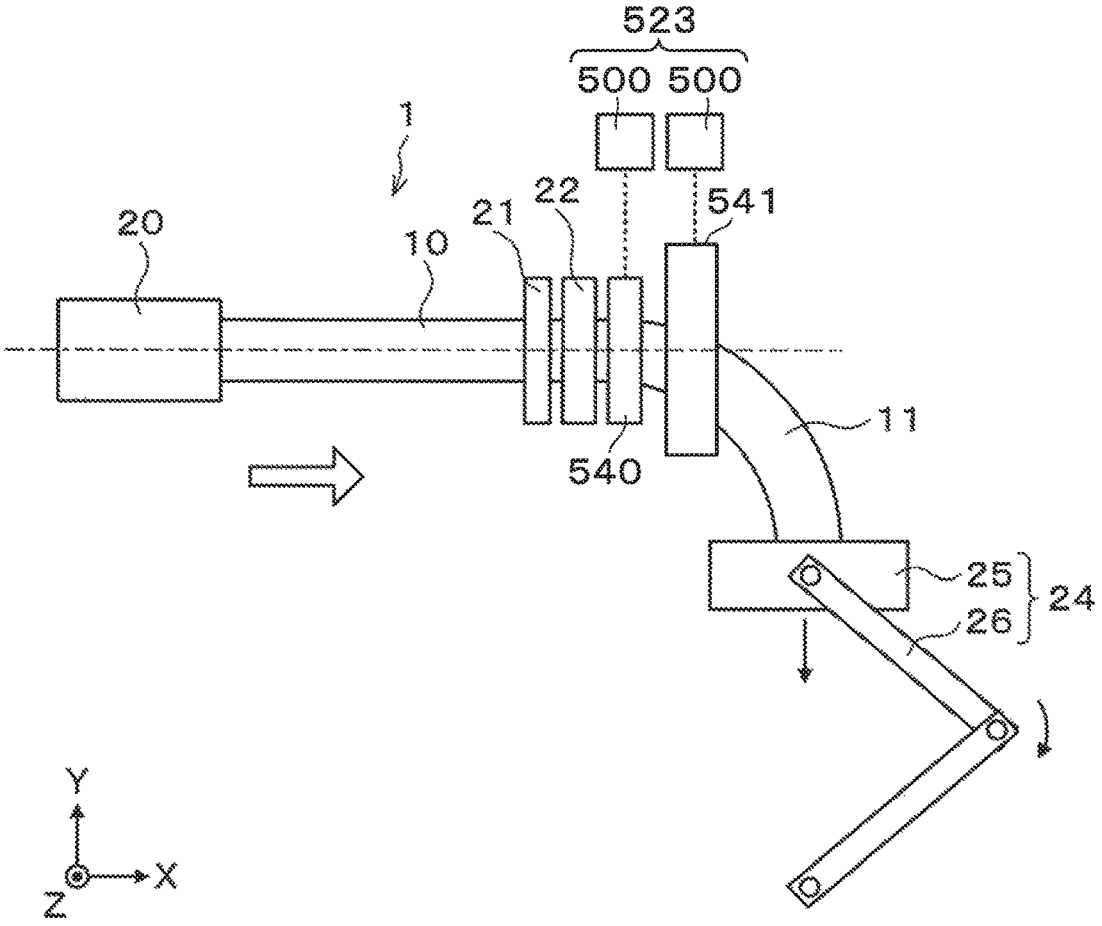
FIG. 27 is a schematic view showing a configuration of the bending device in a case where the cooling apparatus according to the fifth embodiment has a control unit.

In addition, in the first cooling mechanism 540 and the second cooling mechanism 541, the second cooling medium 55 ejected from the respective spray nozzles 554 and 564 may be controlled by a control unit 500 shown in FIG. 27.

In a case where the flow velocity of the second cooling medium 55 is controlled by the control unit 500, it is preferable to set the flow velocity to 2 to 15 m/sec.

For the reason the same as the above-described reason, the lower limit value of the flow velocity of the second cooling medium 55 ejected from the second cooling apparatus 523 according to the present embodiment is set to 2 m/sec. On the other hand, in a case where the flow velocity of the second cooling medium 55 is faster than 15 m/sec, the second cooling medium 55 may flow to the heating apparatus 21 in some cases. Therefore, in the present embodiment, the upper limit value of the flow velocity of the second cooling medium 55 is set to 15 m/sec.

Figure 28:
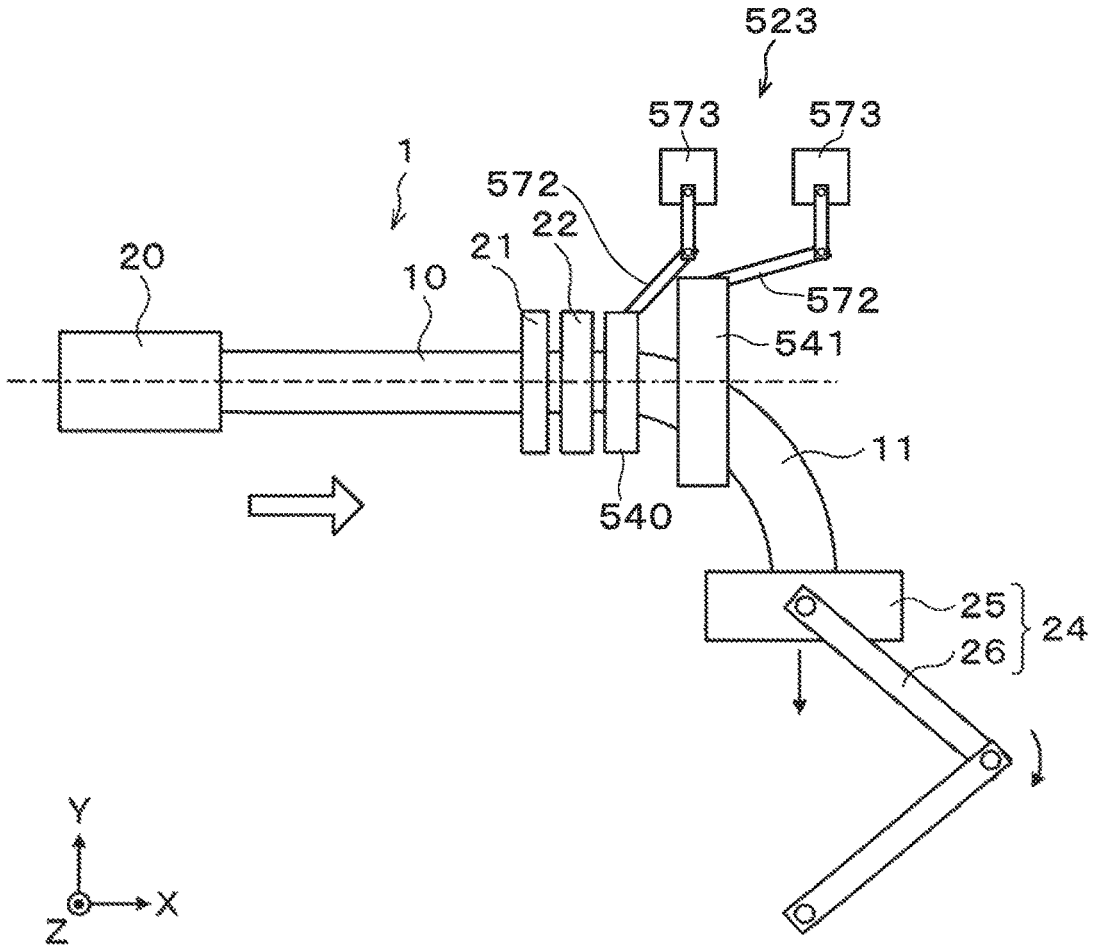
FIG. 28 is a schematic view showing a configuration of the bending device in a case where the cooling apparatus according to the fifth embodiment includes a moving mechanism.
Figure 29:
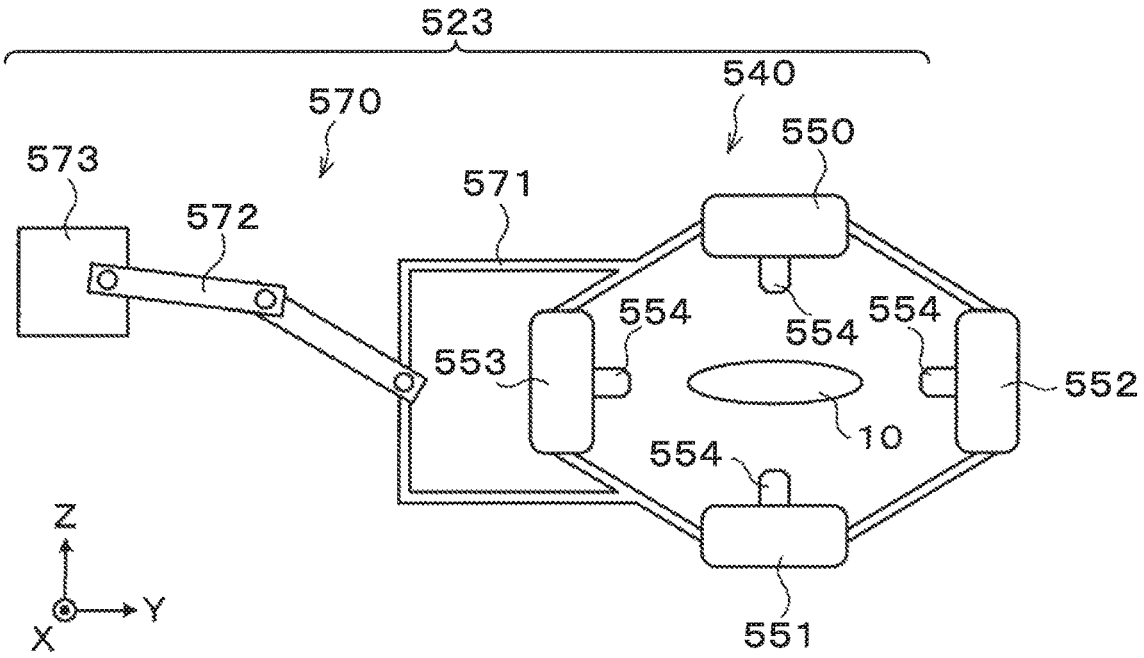
FIG. 29 is a schematic view showing a configuration of the first cooling mechanism and the moving mechanism according to the fifth embodiment.

As shown in FIGS. 28 and 29, the second cooling apparatus 523 according to the present embodiment may have the moving mechanism 570. FIG. 29 shows the moving mechanism 570 disposed in the first cooling mechanism 540. The moving mechanism 570 disposed in the second cooling mechanism 541 also has the same configuration (not shown).

Figure 30:
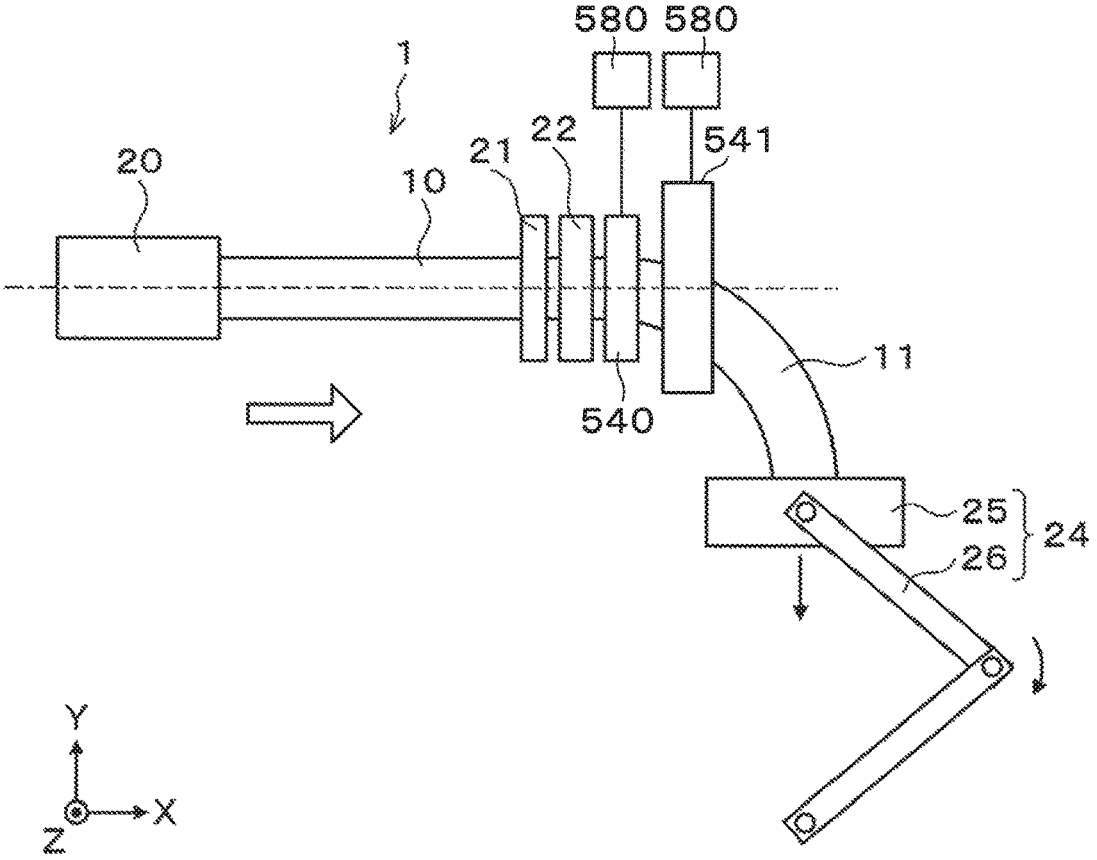
FIG. 30 is a schematic view showing a configuration of the bending device in a case where the cooling apparatus according to the fifth embodiment includes a pulsation providing mechanism.

In addition, as shown in FIG. 30, the second cooling apparatus 523 according to the present embodiment may have a pulsation providing mechanism 580.

As the moving mechanism 570 and the pulsation providing mechanism 580, it is possible to employ those which have the same configuration as that according to the fourth embodiment.

Fifth Embodiment, Cooling Method for Steel Material

Next, a cooling method for the steel material 10 according to the fifth embodiment will be described with reference to FIG. 26.

Figure 26:
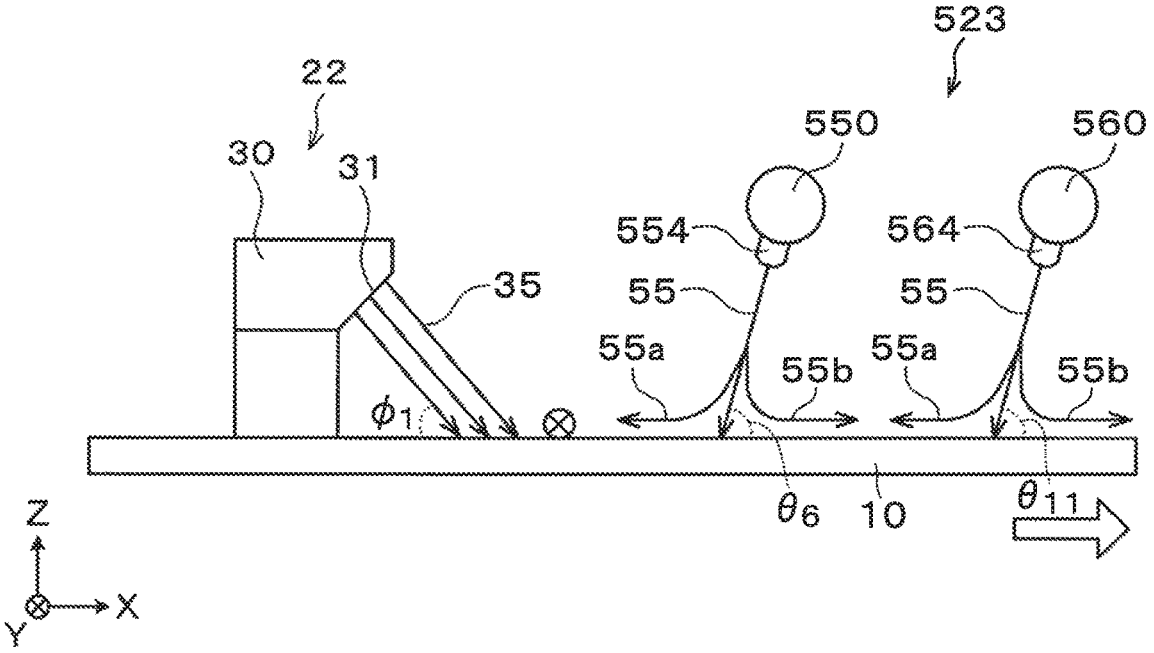
FIG. 26 is a schematic view showing a state where an upper surface of the steel material is cooled using a cooling apparatus according to the fifth embodiment.

FIG. 26 is a schematic view showing a state where an upper surface of the steel material 10 is cooled using the cooling apparatus for the steel material 10 according to the fifth embodiment.

The first cooling medium 35 ejected from the first cooling apparatus 22 collides with the steel material 10 at the collision angle $Ø_1$. After being used in performing the primary cooling on the steel material 10, the first cooling medium 35 flows toward the downstream side.

The second cooling medium 55 ejected from the spray nozzle 554 of the upper header 550 of the first cooling mechanism 540 collides with the steel material 10 at a collision angle $\theta_6$. The second cooling medium 55*a* as a portion of the second cooling medium 55 ejected to the steel material 10 from the spray nozzle 554 flows to the upstream side, and drains the first cooling medium 35. According to the cooling method, when the secondary cooling is performed, the first cooling medium 35 is drained. Accordingly, the second cooling medium 55*b* ejected from the spray nozzle 554 does not receive the influence of the first cooling medium 35, and the secondary cooling can be performed on the steel material 10. After being used in draining the first cooling medium 35, the second cooling medium 55*a* is discharged laterally from the steel material 10 together with the first cooling medium 35. Accordingly, the second cooling medium 55*a* does not flow to the heating apparatus 21 side on the upstream side.

The second cooling medium 55 ejected from the spray nozzle 564 of the upper header 560 of the second cooling mechanism 541 collides with the steel material 10 at a collision angle $\theta_{11}$. The second cooling medium 55*a* as a portion of the second cooling medium 55 ejected to the steel material 10 from the spray nozzle 564 flows to the upstream side, and drains the second cooling medium 55*b*. According to the cooling method, when the secondary cooling is performed, the second cooling medium 55*b* ejected from the spray nozzle 554 is drained. Accordingly, the second cooling medium 55*b* ejected from the spray nozzle 564 is not influenced by the second cooling medium 55*b* ejected from the spray nozzle 554, and the secondary cooling can be performed on the steel material 10.

According to the cooling method for the steel material 10 according to the present embodiment, for the above-described reason, it is possible to reduce the thickness of the temperature boundary layer of the second cooling medium 55. Therefore, it is possible to efficiently cool the steel material 10.

According to the present embodiment, the second cooling medium 55 is ejected toward the upstream side in the feeding direction. Accordingly, the second cooling medium 55*a* ejected to the steel material 10 from the spray nozzle 554 flows to the upstream side, and drains the first cooling medium 35. In addition, the second cooling medium 55*a* ejected to the steel material 10 from the spray nozzle 564 flows to the upstream side, and drains the second cooling medium 55*b* ejected from the spray nozzle 554.

Therefore, without receiving the influence of the first cooling medium 35 whose temperature rises and the second cooling medium 55*b* ejected from the spray nozzle 554, the second cooling medium 55 can be ejected to a protruding side circumferential surface of the bent portion 11 of the steel material 10. Therefore, it is possible to prevent the insufficient quenching on the steel material 10 when bending. As a result, it is possible to perform proper bending to the steel material 10.

In addition, the second cooling medium 55 is provided with both a function to drain the first cooling medium 35 and a function to perform the secondary cooling on the steel material 10. Therefore, it is possible to efficiently cool the steel material 10.

In the present embodiment, the momentum of the second cooling medium 55 in the feeding direction of the steel material 10 may be slightly greater than the momentum of the first cooling medium 35 in the feeding direction of the steel material 10. However, when the momentum of the second cooling medium 55 is two times or greater than the momentum of the first cooling medium 35, there is a possibility that the second cooling medium 55*a* may pass through the first cooling medium 35 and may flow to the heating apparatus 21 located on the upstream side. Accordingly, it is preferable that if the momentum of the second cooling medium 55 is approximately 1 to 1.5 times of the momentum of the first cooling medium 35.

Hitherto, referring to FIG. 26, a case has been described where the upper surface of the steel material 10 is cooled. However, the same cooling method is also used in a case where a lower surface of the steel material 10 is cooled. That is, even in cooling the lower surface of the steel material 10, the second cooling medium 55 ejected from the spray nozzles 554 and 564 of the lower headers 551 and 561 is ejected to the upstream side in the feeding direction as described above. The flow velocity of the second cooling medium 55 is controlled to be 2 to 15 msec. In this manner, the lower surface of the steel material 10 can be properly cooled by the second cooling medium 55.

It is preferable that the flow velocity of the second cooling medium 55 ejected from the spray nozzles 554 and 564 of the lateral headers 552, 553, 562, and 563 is limited to 2 to 15 msec similarly to the upper headers 550 and 560 and the lower headers 551 and 561.

Without being limited to the above-described embodiments, the present invention also includes modifications or combinations of configurations adopted within the scope not departing from the gist of the present invention. Furthermore, as a matter of course, the configurations described in the respective embodiments can be utilized in suitable combination with each other.

EXAMPLE

Hereinafter, content of the present invention will be described in more detail with reference to Examples and comparative examples. The present invention is not limited to the following Examples.

Example 1

A surface temperature of a steel material at a feeding position of the steel material in a case of using the cooling apparatus for the steel material according to the first embodiment will be described with reference to FIGS. 31 and 32.

Figure 31:
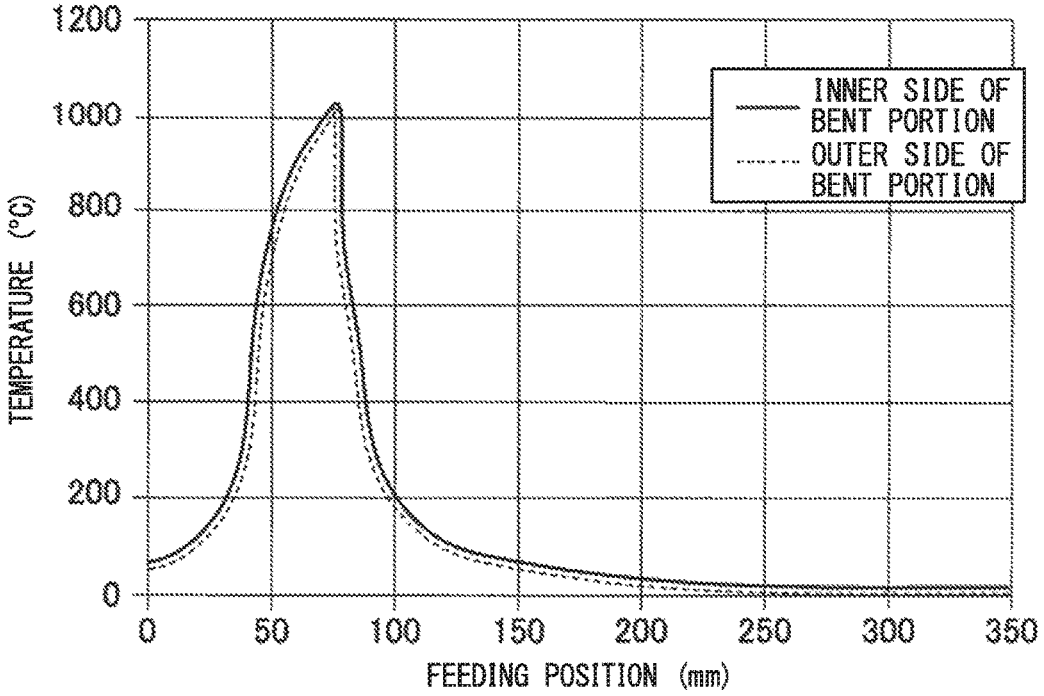
FIG. 31 is a graph showing a result of Example 1-1.

FIG. 31 is a graph showing a result of Example 1-1. FIG. 32 is a graph showing a result of Comparative Example 1-1.

In Example 1-1 and Comparative Example 1-1, as the first cooling apparatus, the first cooling apparatus shown in FIG. 2 is used. In Example 1-1, as the second cooling apparatus, the first cooling mechanism shown in FIGS. 3 and 4, and the second cooling mechanism shown in FIG. 5 are used. On the other hand, in Comparative Example 1-1, the second cooling apparatus disclosed in Patent Document 2 is used.

In Example 1-1, the following conditions are used.

The water amount of the first cooling medium is set to 110 L/min, and the flow velocity is set to 4 m/sec.

The water amount of the second cooling medium ejected from the upper header of the first cooling mechanism is set to 50 L/min. The flow velocity is set to 12 m/sec. The water amount of the second cooling medium ejected from the lower header is set to 50 L/min. The flow velocity is set to 12 m/sec. The water amount of the second cooling medium ejected from the lateral header is set to 18 L/min. The flow velocity is set to 10 m/sec. The water amount of the second cooling medium ejected from the upper header of the second cooling mechanism is set to 75 L/min. The flow velocity is set to 12 m/sec. The water amount of the second cooling medium ejected from the lower header is set to 75 L/min. The flow velocity is set to 12 m/sec. The water amount of the second cooling medium ejected from the lateral header is set to 20 L/min. The flow velocity is set to 10 msec. The first cooling medium is a columnar jet, and the water amount density is 40 $m^3/m^2/min$.

In the secondary cooling, a flat spray nozzle is used as the nozzle of the header. As a spread angle of the upper header and the lower header, the spread angle (ejection angle) of the second cooling medium ejected from the nozzle is set to 50 degrees, and the water amount density is set to 80 $m^3/m^2/min$. In the lateral header, in order to eject the second cooling medium to a flat side surface, the above-described spray spread angle is set to 10 degrees, and the water amount density is set to 40 $m^3/m^2/min$.

Any momentum of the second cooling medium is 1.5 times or greater than that of the first cooling medium.

In Comparative Example 1-1, the following conditions are used. As described above, the first cooling apparatus used in Comparative Example 1-1 is the same as the first cooling apparatus used in Example 1-1. As the conditions relating to the first cooling medium in Comparative Example 1-1, the same conditions as those relating to the first cooling medium in Example 1-1 are also used.

The water amount of the second cooling medium is set to 200 L/min. The flow velocity of the second cooling medium is set to 4 m/sec. The water amount density of the second cooling medium is set to 12 $m^3/m^2/min$. In addition, an ejection form of the second cooling medium is set to a columnar jet.

The momentum of the second cooling medium in the feeding direction of the steel material is 1 times the momentum of the first cooling medium in the feeding direction of the steel material.

Based on the above-described conditions, bending is performed to the steel material. In FIGS. 31 and 32, a horizontal axis represents a position (feeding position) in the feeding direction of the steel material, and a vertical axis represents a surface temperature of the steel material. In addition, in FIGS. 31 and 32, a solid line represents a temperature change at one certain point located inside the bent portion of the steel material, and a dotted line represents a temperature change at one certain point located outside the bent portion of the steel material.

Figure 32:
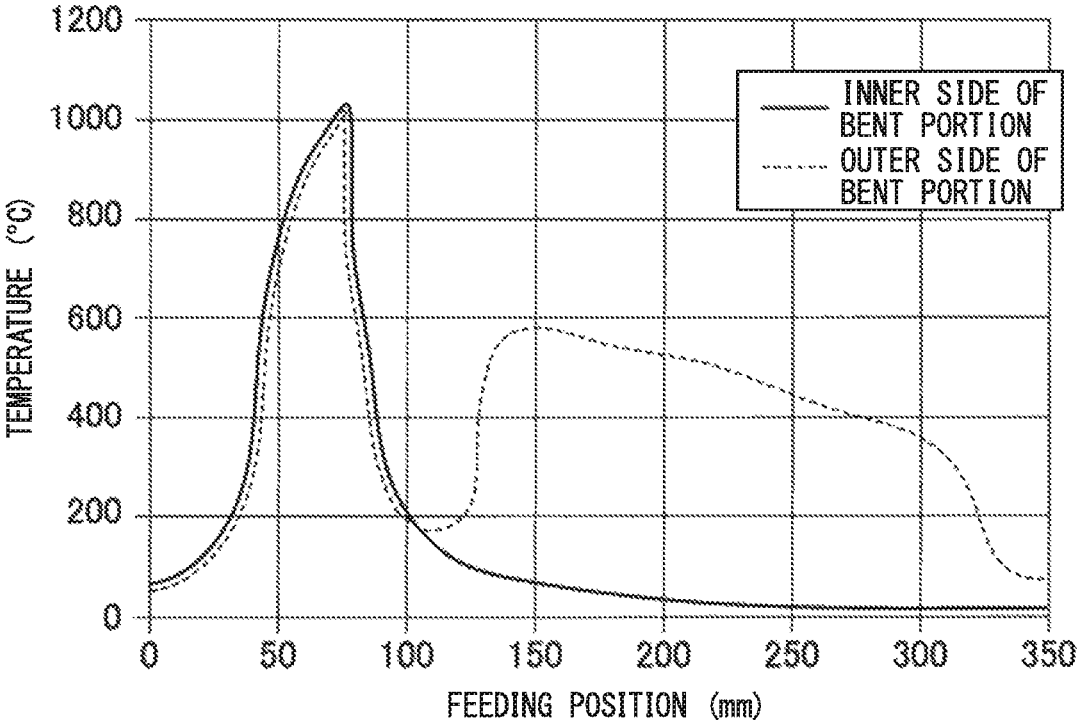
FIG. 32 is a graph showing a result of Comparative Example 1-1.

If FIGS. 31 and 32 are compared with each other, in Comparative Example 1-1, a temperature difference is present between the inside and the outside of the bent portion. In contrast, in Example 1-1, almost no temperature difference is present between the inside and the outside of the bent portion.

Therefore, according to the present invention, it is possible to uniformly cool the inside and the outside of the bent portion of the steel material. Accordingly, it is found that an insufficient quenching which is a problem in the related art can be prevented.

Example 2

Residual stress in a case of using the cooling apparatus for the steel material according to the first embodiment will be described with reference to FIG. 33.

Figure 33:
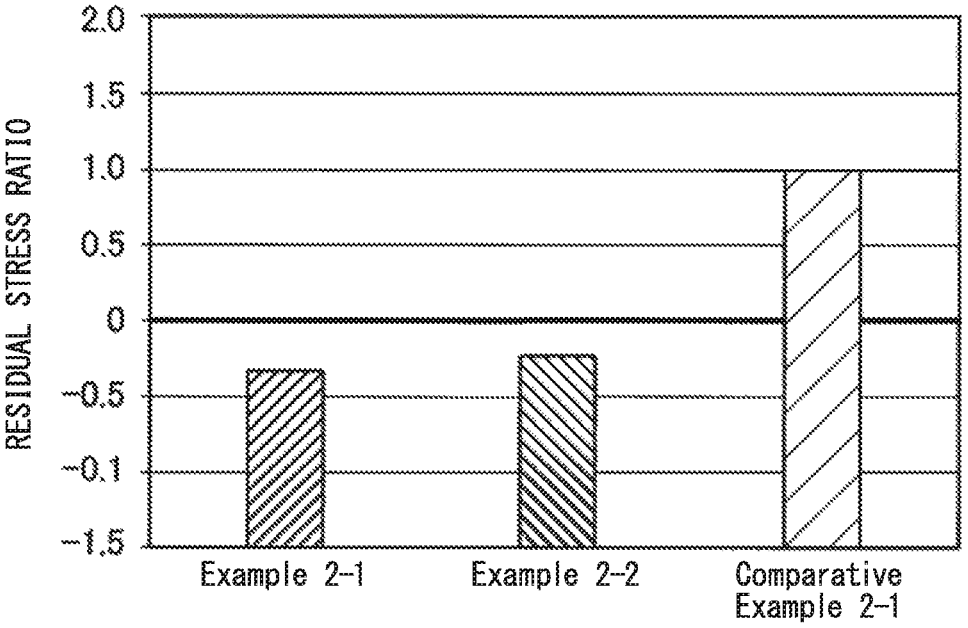
FIG. 33 is a graph showing each result of Examples 2-1 and 2-2, and Comparative Example 2-1.

FIG. 33 is a graph showing each result of Examples 2-1 and 2-2, and Comparative Example 2-1.

The first cooling apparatus used in Example 2-1, Example 2-2, and Comparative Example 2-1 is the same as the first cooling apparatus used in Example 1-1 and Comparative Example 1-1. In addition, the second cooling apparatus used in Example 2-1 and Example 2-2 is the same as the second cooling apparatus used in Example 1-1. More, the second cooling apparatus used in Comparative Example 2-1 is the same as the second cooling apparatus used in Comparative Example 1-1.

As the conditions of Example 2-1, the same conditions as those of Example 1-1 are used except that the water amount of the second cooling medium ejected from the lateral header of the second cooling mechanism is set to 18 L/min.

The conditions of Example 2-2 are as follows.

The water amount of the first cooling medium is set to 110 L/min. The flow velocity of the first cooling medium is set to 3 m/sec. The water amount density of the first cooling medium is set to 40 $m^3/m^2$/min. The ejection form of the first cooling medium is set to a columnar jet.

With regard to the second cooling medium ejected from the upper header and the lower header of the first cooling mechanism, the water amount is set to 60 L/min, and the flow velocity is set to 14 m/sec. With regard to the second cooling medium ejected from the lateral header of the first cooling mechanism, the water amount is set to 23 L/min, and the flow velocity is set to 12 m/sec.

With regard to the second cooling medium ejected from the upper header and the lower header of the second cooling mechanism, the water amount is set to 90 L/min, and the flow velocity is set to 14 m/sec. With regard to the second cooling medium ejected from the lateral header of the second cooling mechanism, the water amount is set to 23 L/min, and the flow velocity is set to 12 m/sec.

As the nozzle of the header of the first cooling mechanism and the second cooling mechanism, a long-radius spray nozzle is used.

With regard to the second cooling medium ejected from the upper header and the lower header of the first cooling mechanism and the second cooling mechanism, the spread angle (ejection angle) is set to 50 degrees, and the water amount density is set to 25 $m^3/m^2$/min.

With regard to the second cooling medium ejected from the lateral header of the first cooling mechanism and the second cooling mechanism, the spread angle (ejection angle) is set to 10 degrees, and the water amount density is set to 28 $m^3/m^2$/min.

The momentum of the second cooling medium in the feeding direction of the steel material is 1.5 times or greater than the momentum of the first cooling medium in the feeding direction of the steel material.

In Comparative Example 2-1, the same conditions as those of Comparative Example 1-1 are used.

Bending is performed to the steel material under the above-described conditions. FIG. 33 shows a result thereof. In FIG. 33, the vertical axis represents residual stress in the steel material after being cooled, and represents a ratio in a case where the residual stress in Comparative Example 2-1 is assumed as 1. In addition, positive residual stress is tensile stress, and negative residual stress is compressive stress.

Referring to FIG. 33, in Comparative Example 2-1, the tensile stress is residual in the steel material. In contrast, in Examples 2-1 and 2-2, the compressive stress is residual in the steel material. Therefore, according to the present invention, it is found that the strength of the steel material is improved.

Example 3

A surface temperature of the steel material at the feeding position of the steel material in a case of using the cooling apparatus for the steel material according to the fifth embodiment will be described with reference to FIG. 34.

Figure 34:
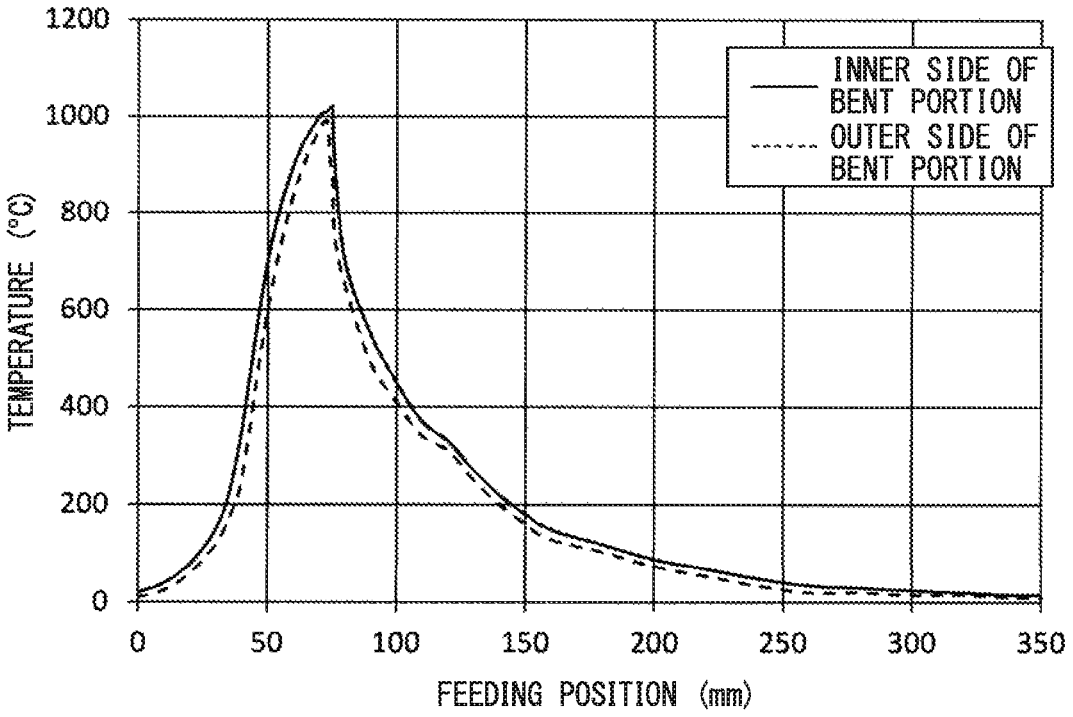
FIG. 34 is a graph showing a result of Example 3-1.

FIG. 34 is a graph showing a result of Example 3-1.

In Example 3-1, the first cooling apparatus shown in FIG. 2 and the second cooling apparatus according to the fifth embodiment are used.

In Example 3-1, the same conditions as those of Example 1-1 are used except that the second cooling apparatus shown in FIG. 25 is used as the second cooling apparatus. In this manner, bending is performed to the steel material.

The horizontal axis in FIG. 34 represents a position (feeding position) in the feeding direction of the steel material, and the vertical axis represents a surface temperature of the steel material. In addition, in FIG. 34, the solid line represents a temperature change at one certain point located inside the bent portion of the steel material, and a dotted line represents a temperature change at one certain point located outside the bent portion of the steel material.

As shown in FIG. 34, in Example 3-1, almost no temperature difference is present between the inside and the outside of the bent portion. The temperature difference as in Comparative Example 1-1 is not present. Therefore, according to the present invention, it is possible to uniformly cool the inside and the outside of the bent portion of the steel material. Accordingly, it is found that an insufficient quenching which is a problem in the related art can be prevented.

INDUSTRIAL APPLICABILITY

According to the above-described respective embodiments, it is possible to provide a cooling apparatus and a cooling method for a steel material, which can reduce an insufficient quenching of the steel material.

BRIEF DESCRIPTION OF THE REFERENCE SYMBOLS

1: Bending Device
10, 200: Steel Material
11: Bend (Bent Portion)
20: Feeding Apparatus
21: Heating Apparatus
22: First Cooling Apparatus (Primary Cooling Apparatus)
23, 223, 323, 423, 523: Second Cooling Apparatus (Secondary Cooling Apparatus)
24: Bending Apparatus
25: Clamp
26: Drive Arm
35: First Cooling Medium
40, 240, 540: First Cooling Mechanism
41, 241, 541: Second Cooling Mechanism
55: Second Cooling Medium
280, 281: Contact Member (Contact Portion)
290, 293: Connecting Member (Connecting Portion)
295, 297, 495: Drive Unit
296, 298: Guide (The Guide Portion)

300: First Draining Mechanism
320: Second Draining Mechanism
321: Third Draining Mechanism
400, 500: Control Unit
480, 580: Pulsation Providing Mechanism

What is claimed is:

1. A bending device for a steel material in which one portion in a longitudinal direction of an elongated steel material is heated in a state where one end portion of the steel material is gripped, and the one end portion is moved in a two-dimensional or three-dimensional direction so as to form the elongated steel material into a predetermined shape including a bent portion and to cool a heated portion including the bent portion while the steel material is fed in the longitudinal direction, the apparatus comprising:

a first cooling apparatus that ejects a first cooling medium to the heated portion; and a plurality of second cooling apparatuses that are disposed on a downstream side from the first cooling apparatus when viewed along a feeding direction of the steel material, and that ejects a second cooling medium to the heated portion, the plurality of the second cooling apparatuses being disposed along the feeding direction, and flow rates of the second cooling medium that are ejected from the plurality of the second cooling apparatus being controllable independently of each other, and wherein each of the second cooling apparatuses includes a plurality of cooling mechanisms, each of which including a header that are disposed along a circumferential direction of the steel material in a cross section across the longitudinal direction of the steel material, and that respectively eject the second cooling medium in a manner that flow rates of the second cooling media are controllable independently of each other, wherein the respective cooling mechanisms are disposed so that the second cooling media ejected from the respective cooling mechanisms do not cross each other until the second cooling media reach the steel material ejected from the respective cooling mechanisms.

2. The bending device for a steel material according to claim 1, further comprising:

a moving mechanism including a motor that maintains each arrangement interval to be constant between the respective second cooling apparatuses adjacent to each other, and that causes an arrangement of the respective second cooling apparatuses to follow the predetermined shape.

3. The bending device for a steel material according to claim 2, wherein the moving mechanism, which is a passive moving mechanism, comprises:

a contact portion which causes the arrangement of the respective second cooling apparatuses to follow the predetermined shape of the steel material by coming into contact with an outer shape of the steel material; and a connecting portion which connects the respective second cooling apparatuses adjacent to each other.

4. The bending device for a steel material according to claim 2, wherein the moving mechanism, which is a passive moving mechanism, comprises:

a contact portion which causes the arrangement of the respective second cooling apparatuses to follow the predetermined shape of the steel material by contacting with an outer shape of the steel material; and a guide portion which regulates a moving direction of the respective second cooling apparatuses.

5. The bending device for a steel material according to claim 2, wherein the moving mechanism, which is an active moving mechanism, comprises:

a drive unit including the motor which moves the respective second cooling apparatuses in accordance with the predetermined shape which is scheduled to apply to the steel material.

6. The bending device for a steel material according to claim 1, wherein the second cooling apparatus located on a downstream side has a relatively larger inner diameter dimension of a space into which the steel material is inserted than the second cooling apparatus located on an upstream side when viewed along the feeding direction.

7. The bending device for a steel material according to claim 1, further comprising:

a first draining mechanism including a nozzle that ejects draining water and drains the first cooling medium flowing downward, at an upstream position than a collision position where the second cooling medium ejected from any one located at a most upstream side in the respective second cooling apparatuses collides with the steel material.

8. The bending device for a steel material according to claim 1, further comprising:

a plurality of second draining mechanisms including a plurality of nozzles that eject draining water and drain the second cooling medium flowing downward, at a downstream position than a collision position where the second cooling medium ejected from any one of the respective second cooling apparatuses collides with the steel material.

9. The bending device for a steel material according to claim 1, wherein at least one of the respective second cooling apparatuses has a pulsation applying mechanism that applies a pulsation to the second cooling medium.

10. The bending device for a steel material according to claim 1, wherein at least a momentum of the second cooling medium ejected at a most upstream position in the second cooling media is greater than a momentum of the first cooling medium ejected at a position adjacent to the most upstream position.

11. The bending device for a steel material according to claim 1, wherein the first cooling medium is a columnar jet, and wherein the second cooling medium is any one of a flat jet, a full cone jet, and an oval jet.

12. A bending device comprising:

a feeding apparatus including a gripper for feeding a steel material in a longitudinal direction of the steel material;

a heating apparatus having a high frequency induction heating coil;

a bending apparatus having a clamp for gripping one end portion of the steel material and a drive arm for moving the clamp;

a first cooling apparatus disposed on a downstream side than the heating apparatus when viewed along a feeding direction of the steel material that ejects a first cooling medium;

a plurality of second cooling apparatuses that are disposed on the downstream side from the first cooling apparatus, disposed along the feeding direction, and that ejects a second cooling medium; and processing circuitry for controlling the cooling medium of each of the second cooling apparatuses, wherein each of the second cooling apparatuses having a plurality of cooling mechanisms, each of which including a header that are disposed along a circumferential direction of the steel material in a cross section across the feeding direction of the steel material and that respectively eject the second cooling medium in a manner that flow rates of the second cooling media are controllable independently of each other, wherein the respective cooling mechanisms are disposed so that the second cooling media ejected from the respective cooling mechanisms do not cross each other until the second cooling media reach the steel material ejected from the respective cooling mechanisms.

13. A method for cooling a steel material, comprising:

gripping one end portion of an elongated steel material;

moving the one end portion in a two dimensional or three-dimensional direction so as to form the elongated steel material into a predetermined shape including a bent portion;

heating one portion in a longitudinal direction of the elongated steel material while the elongated steel material is fed in the longitudinal direction;

a first cooling process of ejecting a first cooling medium to a heated portion; and a plurality of second cooling processes of ejecting a second cooling medium to the heated portion, on a downstream side from an ejection position of the first cooling process when viewed along a feeding direction of the elongated steel material, the second cooling media being ejected to a plurality of locations along the feeding direction of the elongated steel material while flow rates of the second cooling media are controlled independently of each other in the second cooling process, wherein the second cooling media are ejected from a plurality of positions along a circumferential direction of the steel material in a manner that flow rates of the second cooling media in a cross section across the feeding direction of the steel material are controllable independently of each other in the second cooling process, wherein the moving process is a passive moving process in which the predetermined shape of the steel material which is obtained by contacting an outer shape of the steel material is reflected on each arrangement of a plurality of second cooling apparatuses which ejects the second cooling medium and which is disposed along the feeding direction, and the respective second cooling apparatuses are connected to each other so as to maintain each of the ejection interval to be constant in the feeding direction of the second cooling medium.

14. The method for cooling a steel material according to claim 13, wherein the moving process is a passive moving process in which the predetermined shape of the steel material which is obtained by contacting with an outer shape of the steel material is reflected on each arrangement of a plurality of second cooling apparatuses which ejects the second cooling medium and which is disposed along the feeding direction, and a moving direction of the respective second cooling apparatuses is regulated by a guide.

15. The method for cooling a steel material according to claim 13, wherein the moving process is an active moving process in which an ejection position of the second cooling medium is actively moved in accordance with the predetermined shape which is scheduled to apply to the steel material.

16. The method for cooling a steel material according to claim 13, wherein ejection positions of the second cooling media are disposed so that the second cooling media adjacent to each other in the circumferential direction do not cross each other until the second cooling media collide with the steel material.

17. The method for cooling a steel material according to claim 13, further comprising:

a first draining process of ejecting draining water and draining the first cooling medium flowing downward, at an upstream position from a collision position where the second cooling medium located at a most upstream side in the respective second cooling media collides with the steel material.

18. The method for cooling a steel material according to claim 13, further comprising:

a plurality of second draining processes of ejecting draining water and draining the second cooling medium flowing downward, at a downstream position than a collision position where the second cooling medium collides with the steel material in each of the plurality of locations.

19. The method for cooling a steel material according to claim 13, further comprising:

a pulsation applying process of applying a pulsation to at least one of the second cooling media.

20. The method for cooling a steel material according to claim 13, wherein at least a momentum of the second cooling medium ejected at a most upstream position in the second cooling media is greater than a momentum of the first cooling medium ejected at a position adjacent to the most upstream position.

* * * * *